US006253038B1

(12) United States Patent
Ito et al.

(10) Patent No.: US 6,253,038 B1
(45) Date of Patent: Jun. 26, 2001

(54) IMAGE APPARATUS HAVING AN IMPROVED INTERMEDIATE TRANSFER SYSTEM

(75) Inventors: Yoshikuni Ito, Yokohama; Masahiro Inoue; Motohide Shiozawa, both of Mishima, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/385,893

(22) Filed: Aug. 30, 1999

(30) Foreign Application Priority Data

Aug. 31, 1998 (JP) ..... 10-246332
Jan. 28, 1999 (JP) ..... 11-020725

(51) Int. Cl.[7] ..... G03G 15/16; G03G 15/00
(52) U.S. Cl. ..... 399/50; 399/66; 399/302; 399/44
(58) Field of Search ..... 399/50, 66, 44, 399/46, 302, 308

(56) References Cited

U.S. PATENT DOCUMENTS 4,639,749 1/1987 Ito .
5,701,569 * 12/1997 Kanazawa et al. ..... 399/308
5,966,561 * 10/1999 Yamaguchi ..... 399/66
5,999,760 * 12/1999 Suzuki et al. ..... 399/45

FOREIGN PATENT DOCUMENTS 5-223513 * 8/1993 (JP) .

* cited by examiner

*Primary Examiner*—Joan Pendegrass
(74) *Attorney, Agent, or Firm*—Fitzpatrick, Cella, Harper & Scinto

(57) ABSTRACT

In a multiple-color image forming apparatus a voltage which is applied to the intermediate transfer member by the voltage applying device is constant-voltage-controlled, wherein there is a period when the image bearing member which is charged by the charger and on which no toner image is formed by the image forming device and the toner image which is transferred onto the intermediate transfer member exist at the transfer position, a detecting device for detecting a current that flows in the intermediate transfer member from the voltage applying device when the voltage is applied to the intermediate transfer member by the voltage applying device during the period, and a controller for controlling at least one of the voltage which is applied to the image bearing member by the charger and a voltage which is applied to the intermediate transfer member by the voltage applying device on the basis of a detection result by the detecting device.

65 Claims, 12 Drawing Sheets

IMAGE APPARATUS HAVING AN IMPROVED INTERMEDIATE TRANSFER SYSTEM

BACKGROUND OF THE INVENTION

1. Field of the Invention

The present invention relates to an image forming apparatus for conducting image formation such as a copying machine, a printer, and a facsimile machine, and more particularly to an image forming apparatus that transfers a toner image formed on an image bearing member onto an intermediate transfer member and thereafter transfers the toner image on the intermediate transfer member onto a transfer material.

2. Related Background Art

Up to now, there has been known a four-color full color image forming apparatus using an intermediate transfer member. An image forming process will be described in brief. First, a toner image of a first color (yellow) is formed on a photosensitive member and the toner image is then primarily transferred onto the intermediate transfer member. Then, the primary transfer is sequentially conducted on the other three colors, that is, magenta, cyan and black, and the toner images of those four colors are superimposed on the intermediate transfer member. Thereafter, the toner images of the four colors are secondarily transferred in a lump onto a transfer material P such as a sheet by a secondary transfer member, thereby being capable of obtaining a full-color image.

By the way, in the image forming apparatus using the above conventional intermediate transfer member, the primary transfer of the toner image formed on the photosensitive member onto the intermediate transfer member is conducted four times on the yellow, magenta, cyan and black colors. However, there is a case in which at the time of transferring the magenta color of the second time, the yellow toner which has been already transferred onto the intermediate transfer member is returned to the photosensitive member from the intermediate transfer member in the primary transfer position. This is called "counter-transfer", and similarly, the yellow toner and the magenta toner, which have been already transferred onto the intermediate transfer member at the time of transferring the cyan color of the third time, are counter-transferred onto the photosensitive member, and the yellow toner, the magenta toner and the cyan toner which have been already transferred onto the intermediate transfer member at the time of transferring the black color of the fourth time, are counter-transferred onto the photosensitive member.

In the above manner, there arises such a problem that the density of the output image is lowered since the number of times at which the toner primarily transferred more precedently is counter-transferred, that is, the amount of counter-transfers of such a toner is more increased. That is, the color heterogeneity of the output image may occur. In particular, the counter-transfer is liable to occur at the photosensitive member having a photosensitive layer deteriorated by wear or the like, and also becomes remarkable under the circumstances where the temperature is high and the humidity is high.

SUMMARY OF THE INVENTION

The present invention has been made in view of the above circumstances, and therefore an object of the present invention is to provide an image forming apparatus capable of avoiding a reduction in density of a toner image which has been transferred onto an intermediate transfer member from an image bearing member.

Other objects of the present invention will become apparent while reading the following detailed description.

DESCRIPTION OF THE PREFERRED EMBODIMENTS

Hereinafter, a description will be given in more detail of preferred embodiments of the present invention with reference to the accompanying drawings.

(First Embodiment)

Figure 1:
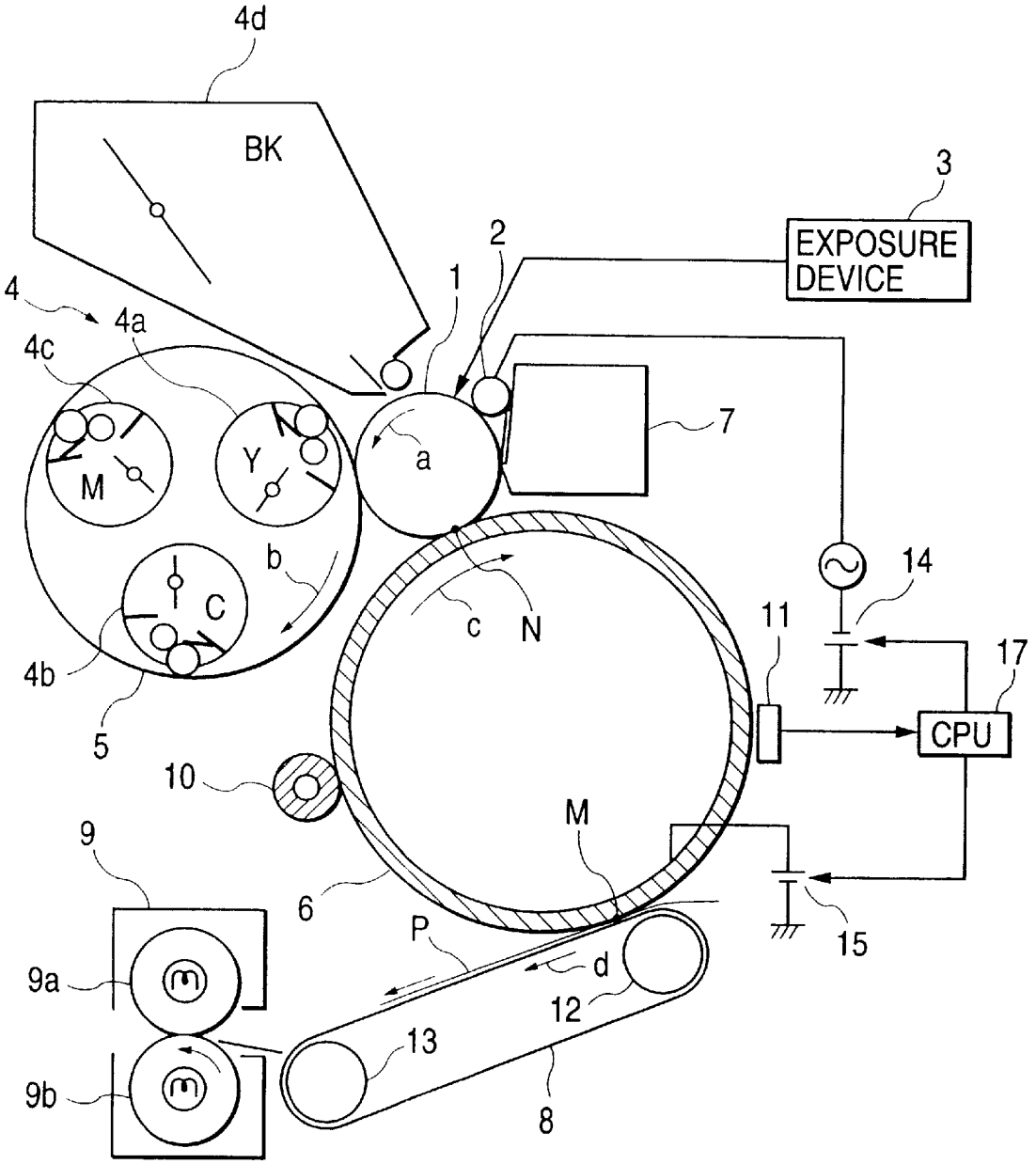
FIG. 1 is a schematically structural view showing an image forming apparatus in accordance with first, second and third embodiments of the present invention.

FIG. 1 is a schematically structural view showing an image forming apparatus (a four-color full color laser beam printer in this embodiment) in accordance with the embodiments of the present invention.

The image forming apparatus according to this embodiment includes an electrophotographic photosensitive member of the rotary drum type (hereinafter referred to as "photosensitive drum") 1 as an image bearing member. Provided in the periphery of the photosensitive drum 1 are a charging roller 2 as charging means, an exposure device (laser scanning unit) 3, a developing device 4, an intermediate transfer drum 6 which is an intermediate transfer member and a cleaning device 7. Also, a secondary transfer belt 8 and a fixing device 9 are disposed in the order from the upstream side in a conveying direction of a transfer material P such as a sheet of paper. On the outer periphery of the intermediate transfer drum 6 is disposed an intermediate transfer drum cleaning roller 10, and a density detecting sensor 11 for density control is disposed so as to oppose the surface of the intermediate transfer drum 6.

Figure 2:
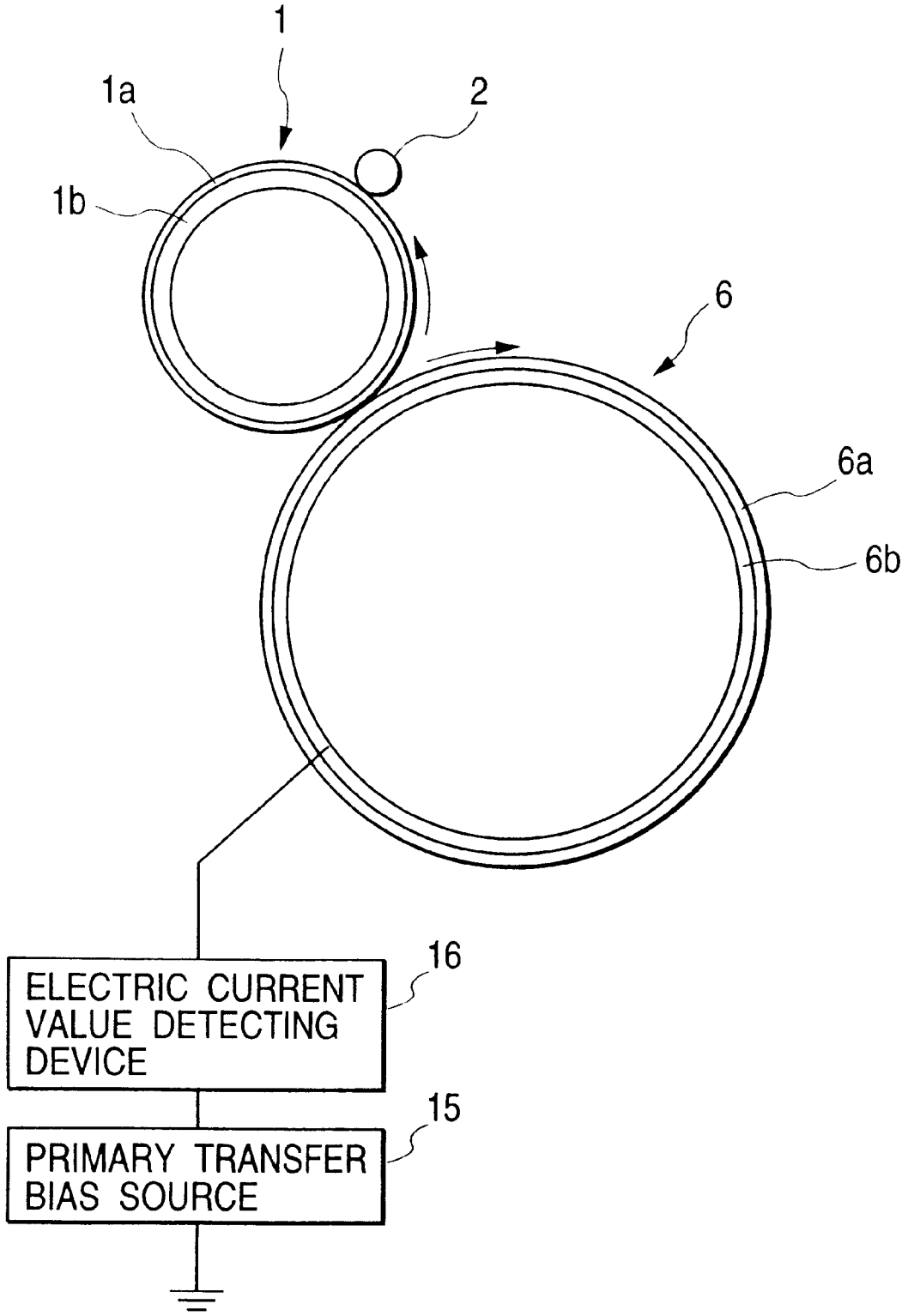
FIG. 2 is a diagram showing a photosensitive drum and an intermediate transfer drum.

The photosensitive drum 1 is structured in such a manner that an organic photoconductive layer 1*a* having a polycarbonate as a main binder is formed on the outer peripheral surface of a cylindrical base 1*b* formed of an aluminum cylinder which is 1 mm in thickness as shown in FIG. 2. The outer diameter of the photosensitive drum 1 is 30 mm. The photosensitive drum 1 is rotationally driven in a direction indicated by an arrow "a" (counterclockwise) at a peripheral speed of 100 mm/sec in a normal image forming process.

Figure 8:
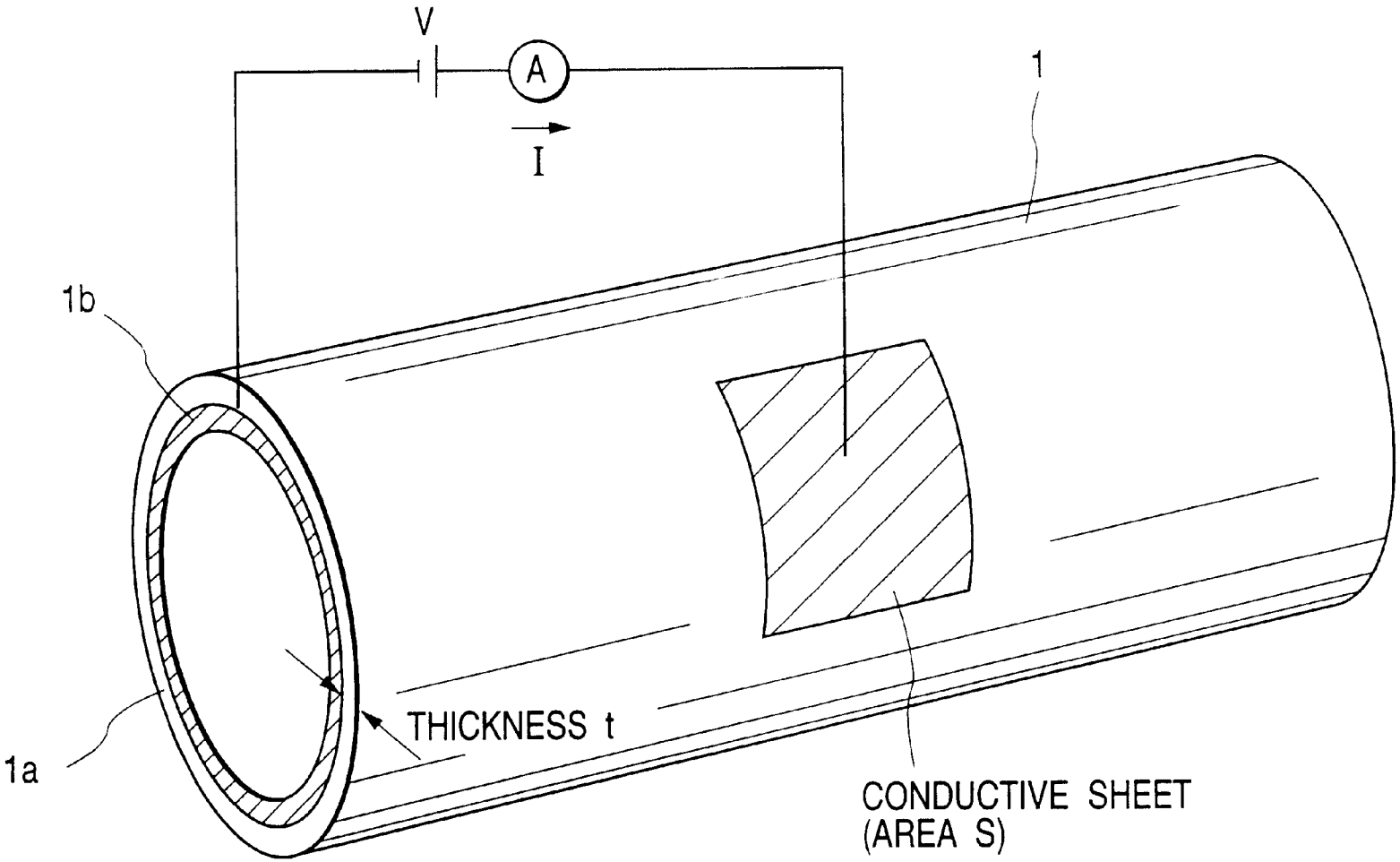
FIG. 8 is a schematically structural view showing a measuring method.

The photoconductive layer is made up of a charge carrier transport layer (CT layer) as a surface layer and a charge carrier generation layer at its inner side, and it is preferable that the volume resistivity of the CT layer is $10^{12}$ to $10^{15}$ Ω≠cm. As a result, it is preferable that the volume resistivity of the entire photoconductive layer is $10^{12}$ to $10^{15}$ Ω·-cm. A method of measuring the volume resistivity will be described with reference to FIG. 8. As shown in the figure, an electrically conductive sheet (aluminum foil or the like) having an area S is stuck onto the surface of the photosensitive member, and a given voltage is applied between the electrically conductive sheet and the base 1*b*. The electric current value I that flows at this time is used to obtain the volume resistivity from the following expression.

In this case, the applied voltage V is 1000 V, the measurement environments are 23° C. and 60 % RH.

$$\text{Volume resistivity}=V/I\times S/t$$

where t is the thickness of the photoconductive layer.

The charging roller 2 is disposed in contact with the surface of the photosensitive drum 1 so as to be rotationally driven, and a given charging bias is applied to the charging roller 2 from a primary charging source 14, to thereby charge the photosensitive drum 1 to a given polarity and electric potential (for example, −550 V). In the present embodiment, a voltage resulting from superposing an AC voltage on a DC voltage is applied thereto.

The exposure device 3 is so designed as to expose the charged photosensitive drum 1 with a laser beam in response to an inputted image information, to thereby form an electrostatic latent image. In this embodiment, the potential of the unexposed portion (dark potential) on the surface of the photosensitive drum 1 after being exposed is about −550 V and the potential of the exposed portion is about −180 V.

The developing device 4 comprises a yellow (Y) developing unit 4*a*, a cyan (C) developing unit 4*b*, a magenta (M) developing unit 4*c* and a black (Bk) developing unit 4*d*. The yellow (Y) developing unit 4*a*, the cyan (C) developing unit 4*b* and the magenta (M) developing unit 4*c* are mounted on the rotary member 5, and the yellow (Y) developing unit 4*a*, the cyan (C) developing unit 4*b* and the magenta (M) developing unit 4*c* are disposed at a position opposite to the photosensitive drum 1 during a developing process by a rotation of the rotary member 5 in a direction indicated by an arrow "b" due to a rotary driving unit (not shown). The black (Bk) developing unit 4*d* is fixedly disposed. Those developing units 4*a*, 4*b*, 4*c* and 4*d* allow a toner to be stuck onto the electrostatic latent image formed on the photosensitive drum 1 and develop the latent image as a toner image. In this embodiment, a development bias of about −350 V is applied to the respective developing units 4*a*, 4*b*, 4*c* and 4*d*, and the potential portion of the exposed portion on the surface of the photosensitive drum 1 is developed with a negative toner so as to visualize the electrostatic latent image.

The cleaning device 7 has a cleaning blade and removes residual toner that has remained on the photosensitive drum 1 after the primary transfer without being primarily transferred onto the intermediate transfer drum 6 by scrapping off the residual toner by the cleaning blade.

The intermediate transfer drum 6 abuts against the surface of the photosensitive drum 1 at a primary transfer nip portion N and abuts against the surface of the secondary transfer belt 8 at a secondary transfer nip portion M so as to rotate in a direction indicated by an arrow "c" (clockwise). The intermediate transfer drum 6 is connected with a primary transfer bias power supply 15 as the transfer means, and a given primary transfer bias (+200 V in this embodiment) is applied to a core (not shown) of the intermediate transfer drum 6 from the primary transfer bias power supply 15, with the result that the toner image formed on the photosensitive drum 1 is primarily transferred onto the intermediate transfer drum 6 by a potential difference (750 V) between the photosensitive drum 1 and the intermediate transfer drum 6 at the primary transfer nip portion N.

The intermediate transfer drum 6 is structured in such a manner that an elastic resistance layer 6*a* made of silicon rubber which is 5 mm in thickness is formed on the outer peripheral surface of a cylindrical base 6*b* formed of an aluminum cylinder which is 3 mm in thickness as shown in FIG. 2, and the elastic resistance layer 6*a* has the resistance value which is adjusted to $10^5$ to $10^{12}$ Ω·cm by dispersing carbon of conductive particles into a silicon rubber. The outer diameter of the intermediate transfer drum 6 is 100 mm, and the hardness of the elastic resistance layer 6*a* is 30° (JIS A). Also, the intermediate transfer drum 2 is brought in pressure contact with the photosensitive drum 1 at the total pressure of 500 gf due to pressurizing means (not shown) and is allowed to rotate at the peripheral speed that is nearly equal to the peripheral speed of the photosensitive drum 1.

It is preferable that the entire volume resistivity of the intermediate transfer member is $10^5$ to $10^9$ Ω·cm.

The measuring method complies with JIS K6911, and the measuring environments are 23° C. and 60%RH. It should be noted that the applied voltage may be set to an appropriate value.

The secondary transfer belt 8 is put on a secondary transfer roller 12 and a drive roller 13 in a stretching manner, and the upper surface of the belt rotates in a direction indicated by an arrow "d" by rotationally driving the drive roller 13. The secondary transfer belt 8 is retractable from and movable into contact with the intermediate transfer drum 6. Also, the secondary transfer roller 12 is connected with a secondary transfer bias power supply (not shown), and a given secondary transfer bias is applied to the secondary transfer roller 12.

The fixing unit 9 is made up of a fixing roller 9*a* and a pressurizing roller 9*b*, and fixes the toner image onto the transfer material P by heating and pressurizing while nipping and conveying the transfer material P on which an unfixed toner image has been transferred at a fixing nip portion between the fixing roller 9*a* and the pressurizing roller 9*b*.

A charging roller 10 for the intermediate transfer drum is connected with a bias power supply (not shown) and removes residual toner remaining on the surface of the intermediate transfer drum 6 after the secondary transfer without being transferred onto the transfer material P. It should be noted that the intermediate transfer drum charging roller 10 is so designed as to charge the residual toner on the intermediate transfer drum 6 after the secondary transfer to a polarity (plus) opposite to the normal charging polarity of the toner, and the secondary transfer residual toner that has been charged to the opposite polarity is transferred to the photosensitive drum 1 from the intermediate transfer drum 6 conversely and removed by the cleaning device 7, simultaneously while the toner image formed on the photosensitive drum 1 is primarily transferred onto the intermediate transfer drum 6.

The density detecting sensor 11 is made up of a light emitting portion and a light receiving portion (not shown) and is designed in such a manner that a spot beam is irradiated from the light emitting portion (not shown) of the density detecting sensor 11 toward the density detection toner image (not shown) that has been transferred on the surface of the intermediate transfer drum 6 from the photosensitive drum 1, and the light receiving portion (not shown) receives the reflected beam so as to detect the density according to the amount of the received light. The density detecting sensor 11 is connected with a control device (CPU) 17.

The intermediate transfer drum 6 is connected as shown in FIG. 2 with an electric current value detecting device 16 that detects a value of an electric current (primary transfer electric current) that flows when the primary transfer bias is applied to the intermediate transfer drum 6 from the primary transfer bias source 15.

The control device 17 controls so that the image density becomes appropriate by changing the image forming conditions such as the developing bias of the developing device 4 on the basis of the light receiving amount information that is inputted from the density detecting sensor 11.

Also, the control device 17 controls the primary charging source 14 in this embodiment so that the value of an electric current (primary transfer electric current) that flows between the photosensitive drum 1 and the intermediate transfer drum 6 becomes a given value or less, and controls so that the charged potential of the photosensitive drum 1 is set to a given value (the details will be described later).

Then, the image forming operation of the above-mentioned image forming apparatus will be described.

In the image forming operation, the photosensitive drum 1 is rotationally driven in a direction indicated by an arrow at a given peripheral speed (process speed), and then charged to a given polarity and potential by the charging roller 2 to which a given charging bias is applied from the primary charging source 14.

Then, an image exposure caused by the laser beam is given to the charged photosensitive drum 1 by the exposure device 3, with the result that an electrostatic latent image is formed in correspondence with a first color component image (for example, a yellow component image) of a desired color image. Then, the electrostatic latent image is developed with the yellow toner that is the first color by the yellow (Y) developing unit 4*a*.

The yellow toner image of the first color which has been formed and born on the photosensitive drum 1 is primarily transferred (intermediate transfer) onto the outer peripheral surface of the intermediate transfer drum 6 due to the pressure at the primary transfer nip portion N and an electric field produced by the primary transfer bias (primary transfer bias is constant-voltage-controlled) which is applied to the intermediate transfer drum 6 by the primary transfer bias source 15 (constant voltage source) in a process where the yellow toner image passes through the primary transfer nip portion N between the photosensitive drum 1 and the intermediate transfer drum 6.

The primary transfer residual toner which remained on the photosensitive drum 1 from which the yellow toner image has been primarily transferred is removed by the cleaning device 7 for the formation of a succeeding color toner image.

Hereinafter, the magenta toner image of the second color, the cyan toner image of the third color and the black toner image of the fourth color which have been formed and born on the photosensitive drum 1 by the magenta (M) developing unit 4*b*, the cyan (C) developing unit 4*c* and the black (Bk) developing unit 4*d* in the above same manner, respectively, are sequentially superposed onto the intermediate transfer drum 6, to thereby form a synthetic color toner image in correspondence with the desired color image.

In this situation, the primary transfer bias which is applied from the primary transfer bias source 15 for sequentially transferring the toner images of the first to fourth colors onto the intermediate transfer drum 6 from the photosensitive drum 1 in the superposing fashion is opposite in polarity to the toner (positive polarity). It should be noted that in a process where the toner images of the first to fourth colors are sequentially superposed and transferred onto the intermediate transfer drum 6 from the photosensitive drum 1, the secondary transfer belt 8 and the intermediate transfer drum cleaning roller 10 are apart from the intermediate transfer drum 6.

Then, the transfer material P such as a sheet of paper is conveyed at a given timing in conformity with the leading end of the synthetic color toner image on the intermediate transfer drum 6.

Then, at a timing when the transfer material P passes in the sheet supplying path that reaches the secondary transfer nip portion M, the secondary transfer belt 8 moves from the apart position so that it abuts against the intermediate transfer drum 6, and a given secondary transfer bias is applied to the secondary transfer roller 12 from the secondary transfer bias source (not shown), with the result that the synthetic color toner image is secondarily transferred onto the transfer material P together.

Then, the transfer material P to which the synthetic color toner image has been transferred is curvature-separated on the downstream side in the conveying direction of the secondary transfer belt 8 and is nipped and conveyed between the fixing roller 9*a* and the pressurizing roller 9*b* of the fixing device 9 so as to be heated and pressurized, with the result that the synthetic color toner image is fixed onto the surface thereof and outputted.

Also, the secondary transfer residual toner which has remained on the intermediate transfer drum 6 without being transferred is converted to the positive polarity by the charging roller 10 for the intermediate transfer member to which the bias is applied and electrostatically transferred onto the photosensitive drum 1 so that the surface of the intermediate transfer drum 6 is cleaned. The secondary transfer residual toner which has been transferred onto the photosensitive drum 1 is thereafter collected by the cleaning device 7.

Then, the control for preventing the above-mentioned counter-transfer from occurring will be described. In this embodiment, the charged potential of the photosensitive drum 1 is set to a given value.

(1) In a control mode (non-image formation) where no image is formed, the secondary transfer belt 8 and the charging roller 10 are made apart from the intermediate transfer drum 6, and a solid image of the yellow of the first color (maximum-density image) is formed on the photosensitive drum 1 over the entire thrust width and primarily transferred onto the intermediate transfer drum 6.

(2) Assuming the primary transfer process of the magenta toner image of the second color, the surface of the photosensitive drum 1 is uniformly charged to the dark potential Vd (V) by the charging roller 2 in advance, and the direct current bias which is constant-voltage-controlled to a given voltage value Vt(V) by the primary transfer bias source 15 is applied to the intermediate transfer drum 6, and the primary transfer electric current (direct current) value Itm ($\mu$A) produced at this time is detected by the electric current value detecting device 16. When the primary transfer electric current value Itm is detected by the electric current value detecting device 16, the upper surface of the intermediate transfer drum 6 is in contact with the photosensitive drum 1 through the yellow toner. In this situation, the image of magenta is not in fact produced and only the direct current bias is applied thereto.

(3) Similarly, assuming the primary transfer process of the cyan toner image of the third color and the black toner image of the fourth color, the surface of the photosensitive drum 1 is uniformly charged to the dark potential Vd (V) by the charging roller 2 in advance, and the direct current bias which is constant-voltage-controlled to a given voltage value Vt(V) by the primary transfer bias source 15 is applied to the intermediate transfer drum 6, and the primary transfer current values Itc and Itk ($\mu$A) produced at this time are detected by the electric current value detecting device 16. Similarly, in this situation, the image of cyan and black is not in fact produced and only the direct current bias is applied thereto.

The above processes (1) to (3) constitute a series of electric current measurement. It should be noted that in the processes (1) to (3), the above Vd is set to, for example, −600 V, and the above Vt is set to, for example, 300 V.

(4) The above Vd is changed, and the above processes (1) to (3) are repeated.

For example, the direct current values Itm, Itc and Itk are sequentially measured when Vd is changed to −550 V, −500 V, −450 V −400 V and −350 V, respectively.

(5) It is assumed that Vd the absolute value of which is the maximum is the dark potential Vd of the photosensitive drum 1 at the time of forming an image, out of Vd where all of Itm, Itc and Itk of the above respective Vd are equal to or less than the above Ith.

For example, assuming that Ith is 1 $\mu$A, and when the measuring result is Vd=−600 V, Itm=20 $\mu$A, Itc=21 $\mu$A and Itk=22 $\mu$A;

when the measuring result is Vd=−550 V,

Itm=12 $\mu$A, Itc=13 $\mu$A and Itk=14 $\mu$A;

when the measuring result is Vd=−500 V,

Itm=5 $\mu$A, Itc=6 $\mu$A and Itk=7 $\mu$A;

when the measuring result is Vd=−450 V,

Itm=1 $\mu$A, Itc=1 $\mu$A and Itk=2 $\mu$A;

when the measuring result is Vd=−400 V,

Itm=0 $\mu$A, Itc=0 $\mu$A and Itk=1 $\mu$A; and when the measuring result is Vd=−350 V, Itm=0 $\mu$A, Itc=0 $\mu$A and Itk=0 $\mu$A.

In this case, Vd becomes −400 V when all of Itm, Itc and Itk are equal to or less than Ith=1 $\mu$A. In this example, it is assumed that the dark potential Vd of the photosensitive drum 1 is −400 V at the time of forming an image.

(6) The density control is conducted at the dark potential Vd of the photosensitive drum 1 which is determined according to the above process (5).

The density control is conducted by the control device 17 in such a manner that the density of the toner image (patch pattern) for the density detection (not shown) which is formed on the intermediate transfer drum 6 is detected by the density detecting sensor 11, and the developing bias Vdc which allows the optimum density is determined on the basis of the density information of the toner image for the density detection which is detected by the density detecting sensor 11.

Figure 3:
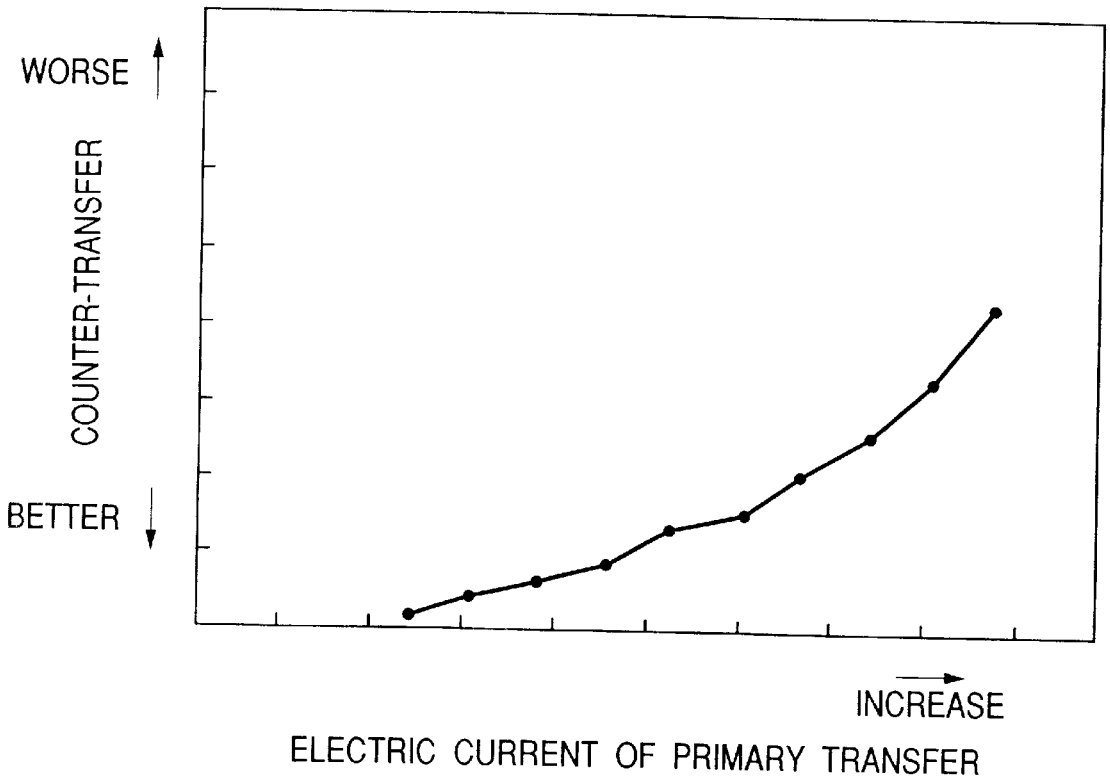
FIG. 3 is a graph showing a relation between a primary transfer electric current and a counter-transfer.

According to the present inventors' study, it is proved as shown in FIG. 3, that the amount of counter-transfer toner increases more as the primary transfer electric current that flows in the intermediate transfer drum 6 from the primary transfer bias source 15 increases. The amount of counter-transfer toner can be quantitatively measured by measuring the weight or by peeling off the counter-transfer toner with a tape and sticking it onto the transfer material to measure the density of reflection, or the like manner. It should be noted that in FIG. 3, "better" of counter-transfer in the axis of ordinate represents that the amount of counter-transfer is small whereas "worse" thereof represents that the amount of counter-transfer is large.

As described above, in this embodiment, when the charging bias due to the primary charging source 14 is controlled in such a manner that the charged potential (dark potential) Vd of the photosensitive drum 1 is set to about −400 V, the primary transfer electric current value Ith that flows between the photosensitive drum 1 and the intermediate transfer drum 6 is set to 1 $\mu$A, thereby being capable of reducing the amount of counter-transfer, with the result that an output image having no deteriorated density can be obtained.

In this embodiment, Ith is 1 $\mu$A, but it is preferable that the primary transfer electric current value Ith is 0 $\mu$A, which more reduces the counter-transfer.

Also, the reason that the dark potential Vd of the photosensitive drum 1, the primary transfer electric current Ith of which is equal to or less than a given value and the absolute value of which is the maximum, is selected is because the contrast potential (a difference between the developing bias $V_{DC}$ and $V_L$) and a fog potential (a difference between $V_D$ and the developing bias $V_{DC}$) are going to increase. This makes it possible to ensure the tone reproduction of the output image and it difficult to generate the fogged image.

(Second Embodiment)

A second embodiment of the present invention will be described similarly with reference to the image forming apparatus shown in FIG. 1. In this embodiment, since the image forming operation is identical with that in the first embodiment, only the control for preventing the counter-transfer from occurring will be described. In this embodiment, the primary transfer potential of the intermediate transfer drum 6 is set to a given value.

(1) In a control mode (non-image formation) where no image is formed, the secondary transfer belt 8 and the charging roller 10 are made apart from the intermediate transfer drum 6, and a solid image of the yellow of the first color is formed on the photosensitive drum 1 over the entire thrust width and primarily transferred onto the intermediate transfer drum 6.

(2) Assuming the primary transfer process of the magenta toner image of the second color, the surface of the photosensitive drum 1 is uniformly charged to the dark potential Vd (V) by the charging roller 2 in advance, and the direct current bias which is constant-voltage-controlled to a given voltage value (detected voltage) Vt (V) by the primary transfer bias source 15 is applied to the intermediate transfer drum 6, and the primary transfer electric current value Itm ($\mu$A) produced at this time is detected by the electric current value detecting device 16. When the primary transfer electric current value Itm is detected by the electric current value detecting device 16, the upper surface of the intermediate transfer drum 6 is in contact with the photosensitive drum 1 through the yellow toner. In this situation, the image of magenta is not in fact produced and only the direct current bias is applied thereto.

(3) Similarly, assuming the primary transfer process of the cyan toner image of the third color and the black toner image of the fourth color, the surface of the photosensitive drum 1 is uniformly charged to the dark potential Vd (V) by the charging roller 2 in advance, and the direct current bias which is constant-voltage-controlled to a given voltage value Vt (V) by the primary transfer bias source 15 is applied to the intermediate transfer drum 6, and the primary transfer electric current values Itc and Itk ($\mu$A) produced at this time are detected by the electric current value detecting device 16. Similarly, in this situation, the image of cyan and black is not in fact produced and only the direct current bias is applied thereto.

The above processes (1) to (3) constitute a series of electric current measurement. It should be noted that in the processes (1) to (3), the above Vd is set to, for example, −600 V, and the above Vt is set to, for example, 300 V.

(4) The above Vt is changed, and the above processes (1) to (3) are repeated.

For example, the direct current values Itm, Itc and Itk are sequentially measured when Vt is changed to 250 V, 200 V, 150 V, 100 V and 50 V, respectively.

(5) It is assumed that Vt the absolute value of which is the maximum is the primary transfer potential Vd of the photosensitive drum 1 at the time of forming an image, out of Vd where all of Itm, Itc and Itk of the above respective Vt are equal to or less than the above Ith.

For example, assuming that Ith is 1 $\mu$A, and
when the measuring result is Vt=300 V,
Itm=20 $\mu$A, Itc=21 $\mu$A and Itk=22 $\mu$A;
when the measuring result is Vt=250 V,
Itm=12 $\mu$A, Itc=13 $\mu$A and Itk=14 $\mu$A;
when the measuring result is Vt=200 V,
Itm=5 $\mu$A, Itc=6 $\mu$A and Itk=7 $\mu$A;
when the measuring result is Vt=150 V,
Itm=1 $\mu$A, Itc=1 $\mu$A and Itk=2 $\mu$A;
when the measuring result is Vt=100 V,
Itm=0 $\mu$A, Itc=0 $\mu$A and Itk=1 $\mu$A; and
when the measuring result is Vt=50 V,
Itm=0 $\mu$A, Itc=0 $\mu$A and Itk=0 $\mu$A.

In this case, Vt becomes 100 V when all of Itm, Itc and Itk are equal to or less than Ith=1 $\mu$A. In this example, it is assumed that the primary transfer potential Vt at the time of forming an image is equal to 100 V.

(6) The density control is conducted at the primary transfer potential Vt which is determined according to the above process (5).

The density control is conducted by the control device 17 in such a manner that the density of the toner image (patch pattern) for the density detection (not shown) which is formed on the intermediate transfer drum 6 is detected by the density detecting sensor 11, and the developing bias Vdc which allows the optimum density is determined on the basis of the density information of the toner image for the density detection which is detected by the density detecting sensor 11.

As described above, in this embodiment, when the primary transfer potential Vt of the intermediate transfer drum 6 is set to 100 V, the primary transfer electric current value Ith that flows between the photosensitive drum 1 and the intermediate transfer drum 6 is set to 1 $\mu$A, thereby being capable of reducing the amount of counter-transfer, with the result that an output image having no deteriorated density can be obtained. In this embodiment, Ith is 1 $\mu$A, but it is preferable that Ith is 0 $\mu$A, which more reduces the counter-transfer.

In this embodiment, the density control of the above process (6) may not be always conducted.

Also, the reason that Vt when Ith is equal to or less than a given value and the absolute value is the largest is selected is to maintain the transfer property. This is because when the transfer potential is lowered, the transfer efficiency slightly drops.

(Third Embodiment)

A third embodiment of the present invention will be described similarly with reference to the image forming apparatus shown in FIG. 1. In this embodiment, since the image forming operation is identical with that in the first embodiment, only the control for preventing the counter-transfer from occurring will be described. In this embodiment, the charging bias due to the primary charging source 14 (the charged potential of the photosensitive drum 1) and the primary transfer voltage of the intermediate transfer drum 6 are set to a given value.

The operations in the above processes (1) to (3) of the first and second embodiments are conducted in the same manner, and the charging bias due to the primary charging source 14 (the charged potential of the photosensitive drum 1) and the primary transfer voltage of the intermediate transfer drum 6 are varied, respectively. That is,
when Vd=−600 V,
Vt=300 V, 250 V, 200 V, 150 V, 100 V and 50 V;
when Vd=−550 V,
Vt=300 V, 250 V, 200 V, 150 V, 100 V and 50 V;
when Vd=−500 V,
Vt=300 V, 250 V, 200 V, 150 V, 100 V and 50 V;
when Vd=−450 V,
Vt=300 V, 250 V, 200 V, 150 V, 100 V and 50 V;
when Vd=−400 V,
Vt=300 V, 250 V, 200 V, 150 V, 100 V and 50 V; and
when Vd=−350 V,
Vt=300 V, 250 V, 200 V, 150 V, 100 V and 50 V.
That is, there are 36 Vt.

From the above combination, similarly to the first and second embodiments, setting of Vd and Vt is selected when all of Itm, Itc and Itk are equal to or less than a given value Ith. Vd is selected for the variable amount of Vd and Vt so that Vt is prevented from changing as much as possible. This is to maintain the transfer property.

As described above, according to this embodiment, since both of Vd and Vt are variable, the primary transfer electric current value Ith that flows between the photosensitive drum 1 and the intermediate transfer drum 6 is set to a given value or less, thereby being capable of effectively reducing the amount of counter-transfer, with the result that the output image having no deteriorated density can be obtained.

Also, in the above first and second embodiments, only the yellow solid image is formed to detect Itm, Itc and Itk. However, this can be made because the first color is yellow, and the present invention is not limited to this when the color order is different. In other words, the first color is imaged, and the primary transfer process of the second to fourth colors are assumed, to thereby detect an electric current that flows at this time.

Also, the number of times of counter-transfer increases more as the number of times when the toner image passes through the primary transfer position N after the toner image has been transferred is large, with the result that the amount of toner of the first-color toner image on the intermediate transfer drum 6 is reduced. For that reason, in the above first and second embodiments, the following expression is satisfied.

$$Itm<Itc<Itk$$

For that reason, this is an easy case in which only Itk is detected and the above-mentioned control is conducted, and there is a case in which the sufficient effect on the counter-transfer is obtained.

Conversely, although being complicated, there is a case in which the toner image of the second color is formed, and an electric current at the primary transfer time of the third and fourth colors is detected, and there is a case in which the toner image of the third color is formed, and an electric current at the primary transfer time of the fourth color is detected. In this case, a plurality of colors may be formed at positions different in the main scanning direction on the intermediate transfer drum 6 so that electric currents for a plurality of colors are detected at changed timing in one image formation at once, and in this case, the tact time of this control is shortened.

Also, the image formed during the above control is a solid image of the total thrust width. However, if half-tone, gradation patch, secondary color, tertiary color and so on are fixed for each control, the present invention is not limited to this.

When the values of the above Vd and Vt change, a plurality of Vd and Vt may be set at changed timing in one image formation to detect the electric current, and this makes it possible to shorten the tact time of this control.

In addition, if the charged potential of the photosensitive drum 1 and the primary transfer potential of the intermediate transfer drum 6 are monitored by an electrometer and fed back, control can be made with higher accuracy.

Also, there is a case in which an upper limit is given to the absolute value of a difference between Vd and Vt, and the above control is conducted within that range so that the more effect on the counter-transfer is obtained.

Also, the values of Vd, VL and Vt are not limited to this embodiment, and the same effect is obtained if they are optimized for each system.

(Fourth Embodiment)

Figure 4:
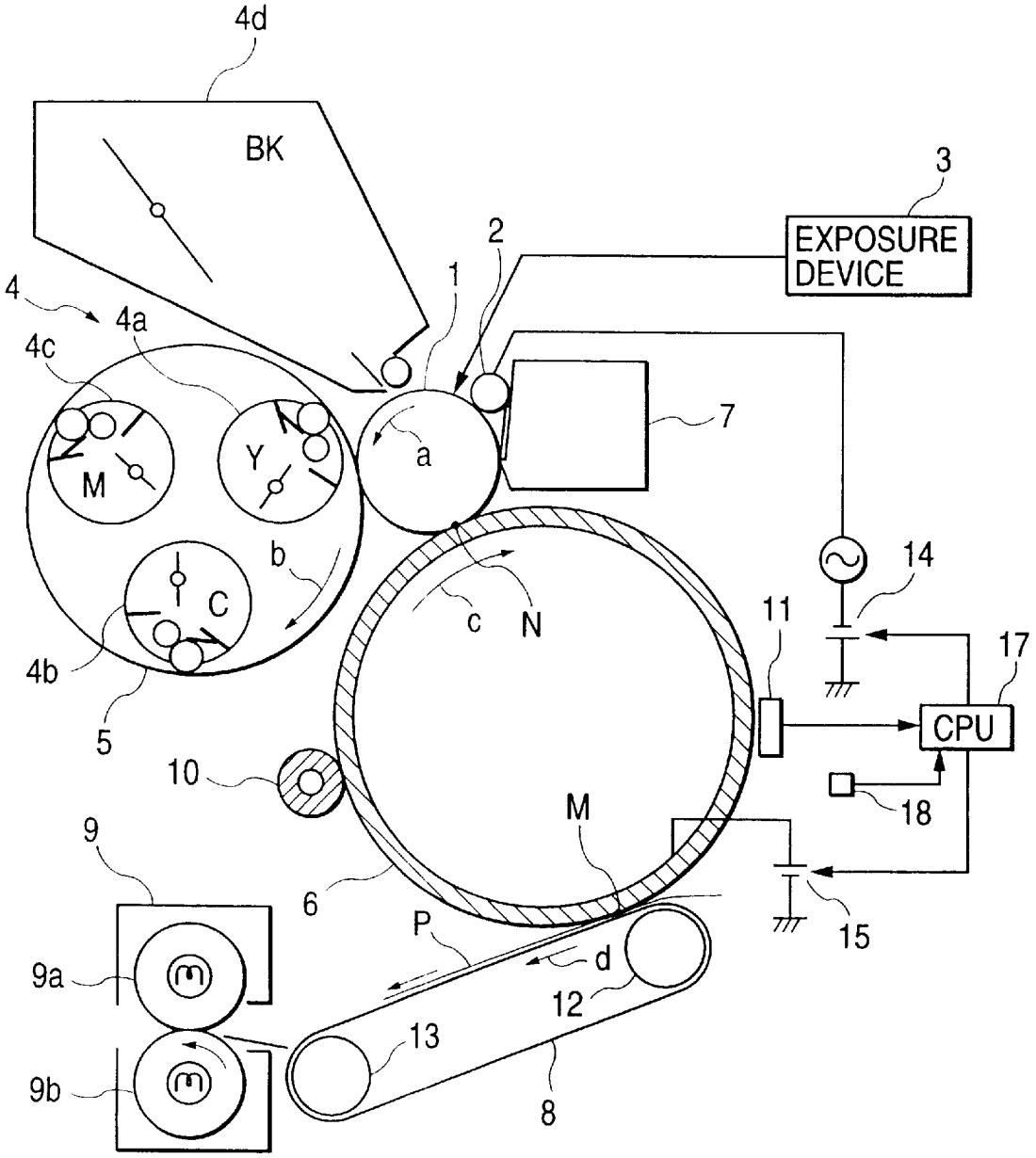
FIG. 4 is a schematically structural view showing an image forming apparatus in accordance with a fourth embodiment of the present invention.

FIG. 4 is a schematically structural view showing an image forming apparatus in accordance with a fourth embodiment of the present invention. It should be noted that the same parts as those in the image forming apparatus in accordance with the first embodiment shown in FIG. 1 are designated by identical references, and duplex description will be omitted.

From the viewpoint that counter-transfer is liable to occur under the high-temperature and high-humidity environments, in this embodiment, as shown in FIG. 4, a temperature and humidity detecting sensor 18 is disposed within an image forming apparatus, and the detected temperature and humidity information is inputted to the control device 17. The control device 17 is so designed as to set the charging bias due to the primary charging source 14 (the charged potential of the photosensitive drum 1) and/or the primary transfer voltage to given values, such as a control to prevent the counter-transfer of the above first, second and third embodiments from occurring, in the case where the temperature and humidity are high (for example, the temperature of 30° C. and the humidity of 80%), on the basis of the inputted temperature and humidity information.

As described above, similarly in this embodiment, the amount of counter-transfer can be reduced so that an output image having no deteriorated density can be obtained.

(Fifth Embodiment)

Figure 5:
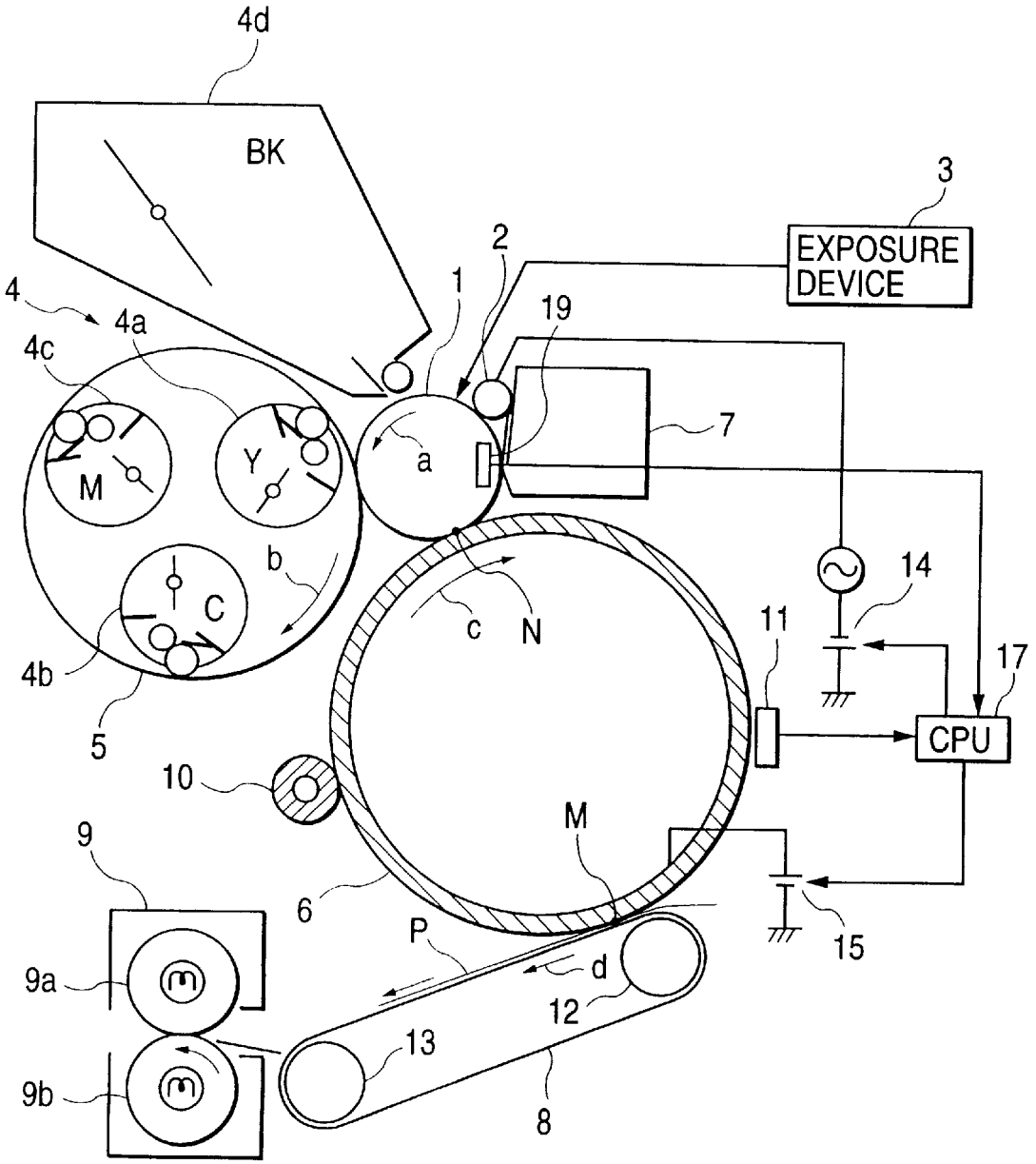
FIG. 5 is a schematically structural view showing an image forming apparatus in accordance with a fifth embodiment of the present invention.

FIG. 5 is a schematically structural view showing an image forming apparatus in accordance with a fifth embodiment of the present invention. It should be noted that the same parts as those in the image forming apparatus in accordance with the first embodiment shown in FIG. 1 are designated by identical references, and duplex description will be omitted.

From the view point that counter-transfer is liable to occur as the coat thickness of the photoconductive layer (that is, CT layer) reduces more because the photosensitive drum wears, in this embodiment, there is provided a photosensitive drum life detecting sensor 19 (coat thickness detecting sensor) as shown in FIG. 5, and the detected photosensitive drum life information is inputted to the control device 17. The control device 17 is so designed as to turn on/off the control of preventing the counter-transfer from occurring in the above first, second and third embodiments in response to the progress of the life of the photosensitive drum 1 due to the inputted photosensitive drum life information and set the primary transfer electric current value Ith that flows between the photosensitive drum 1 and the intermediate transfer drum 6 to a given value or less.

As described above, similarly in this embodiment, the amount of counter-transfer can be reduced so that an output image having no deteriorated density can be obtained.

The temperature and humidity control and the control due to the life of the photosensitive drum 1 in the fourth and fifth embodiments are made because an electric current at the primary transfer time increases by lowering the electric resistance of the photosensitive drum 1, the intermediate transfer drum 6 or the like under high temperature and high humidity environment, by lowering the electric resistance with the photoconductive layer of the photosensitive drum 1 being worn due to the durability of the photosensitive drum 1, and so on, and the present invention is not limited to this depending on the construction of the image forming apparatus.

(Sixth Embodiment)

Figure 6:
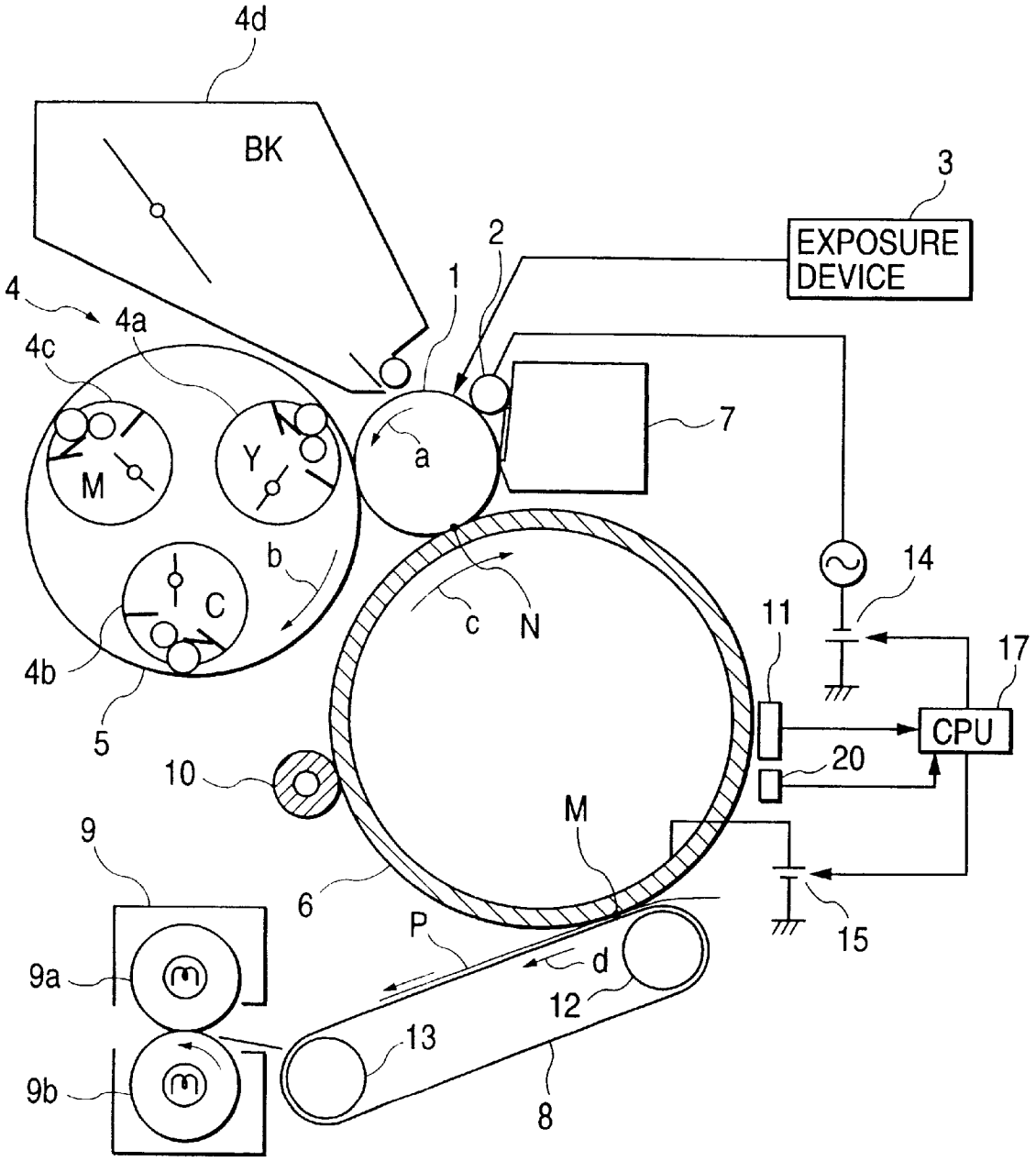
FIG. 6 is a schematically structural view showing an image forming apparatus in accordance with a sixth embodiment of the present invention.

FIG. 6 is a schematically structural view showing an image forming apparatus in accordance with a sixth embodiment of the present invention. It should be noted that the same parts as those in the image forming apparatus in accordance with the first embodiment shown in FIG. 1 are designated by identical references, and duplex description will be omitted.

In this embodiment, as shown in FIG. 6, a toner image reflection density sensor 20 is so disposed as to oppose the surface of the intermediate transfer drum 6, and the detected reflection density information of the toner image which has not yet been secondarily transferred is inputted to the control device 17. The control device 17 is so designed as to judge whether counter-transfer occurs or not, on the basis of the inputted reflection density information of the toner image, and if judging that counter-transfer occurs, turns on/off the control of preventing the occurrence of the counter-transfer in the above first to fifth embodiments to set the primary transfer electric current value Ith that flows between the photosensitive drum 1 and the intermediate transfer drum to a given value or less.

As described above, also in this embodiment, the amount of counter-transfer can be reduced so that an output image having no deteriorated density can be obtained.

In the above-described respective embodiments, the intermediate transfer drum was exemplified as the intermediate transfer member for description. However, the present invention is not limited to the drum shape if it is an intermediate transfer member, and the same effect is obtained if the belt-shaped intermediate transfer member is used.

(Seventh Embodiment)

Figure 7:
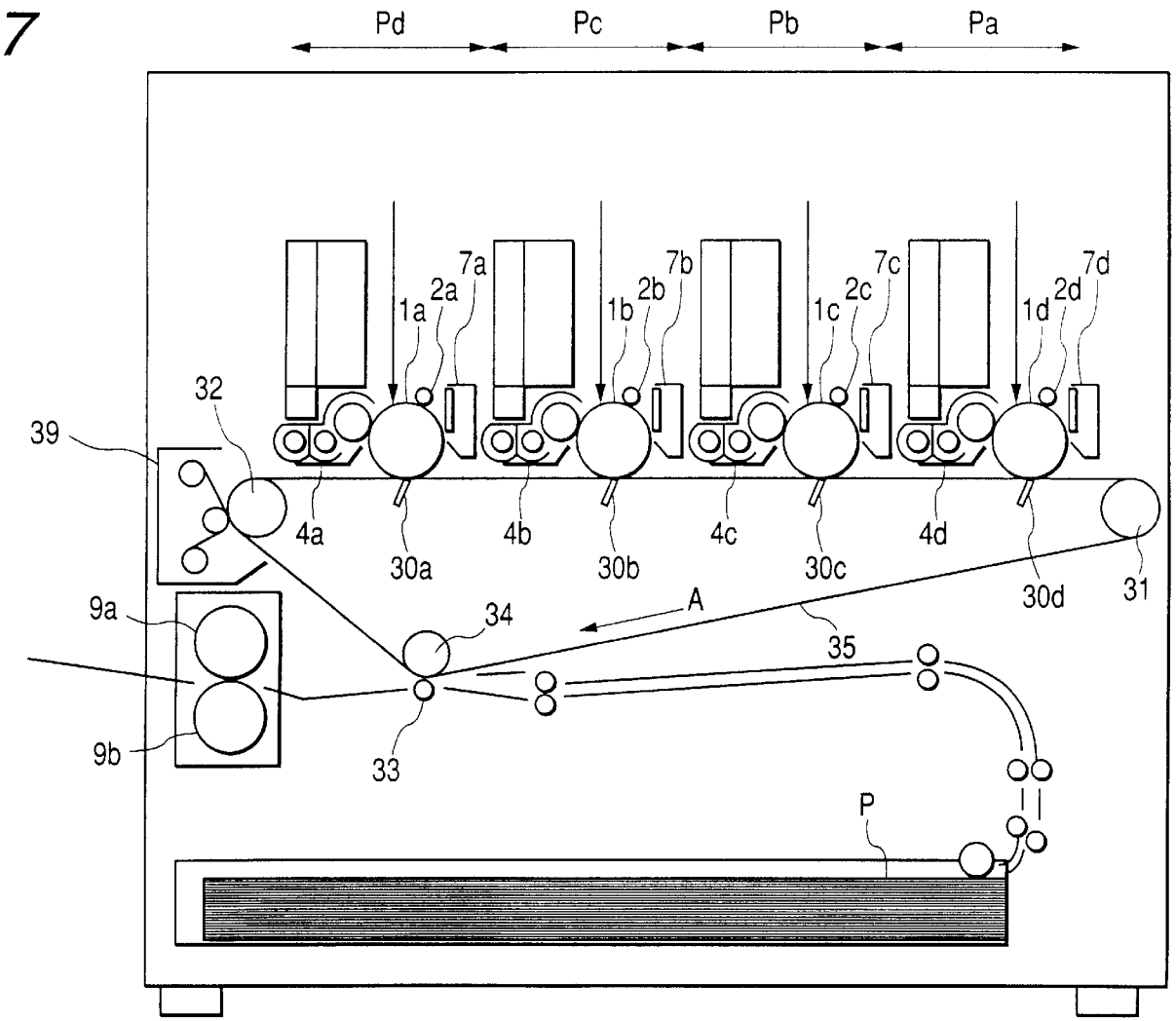
FIG. 7 is a schematically structural view showing another image forming apparatus to which the present invention is applicable.

Also, the present invention is applicable to the tandem type image forming apparatus in which a plurality of image forming sections are disposed as shown in FIG. 7. It should be noted that in FIG. 7, the same parts as those in the first to sixth embodiments are designated by the identical references and their duplex description will be omitted. The image forming apparatus will be described in brief.

The respective color toner images which are sequentially formed onto the photosensitive drums 1*a* to 1*d* are sequentially transferred onto an intermediate transfer belt 35 by a power supply (not shown) as transfer means and transfer blades (30*a* to 30*d*) in a superposing manner. Thereafter, a transfer material P is fed at a timing when the toner image is conveyed, and the toner image is electrostatically transferred onto the transfer material from the intermediate transfer belt by a secondary transfer roller 33.

In this embodiment, the volume resistivity of the intermediate transfer member and the photosensitive member is the same as those in the first to sixth embodiments, and it is preferable that the volume resistivity of the transfer blade as the transfer means is smaller than $10^5$ Ω·cm. The measuring method complies with JIS K6911, and the measuring environments are 23° C. and 60% RH. It should be noted that the applied voltage may be set to an appropriate value.

In other words, although the same is applied to the above first to sixth embodiments, in the present invention, in a system where the actual resistance value of the photosensitive member (which is determined by an electric current (developed voltage) which flows when a certain voltage (electric current) is applied) is 1/10 or less of the actual resistance value of the intermediate transfer member (and transfer blade), a remarkable problem, that is, counter-transfer caused by lowering the resistance of the photosensitive member due to the deterioration of the photosensitive member can be prevented.

In the image forming apparatus thus structured, since there is a case in which an error in manufacture of the photosensitive drum and the degree of deterioration (wearing degree) are different, the present invention is particularly effective.

In other words, in the image forming apparatus according to this embodiment, similarly to the first to fifth embodiments, the charging bias due to the primary charging sources 2*a* to 2*d* (the charged potentials of the photosensitive drums 1*a* to 1*d*) and/or the primary transfer voltage which is applied to the intermediate transfer belt 35 through the transfer blades 30*a* to 30*d* are controlled by the control device.

Accordingly, also, in the image forming apparatus according to this embodiment, an output image having no deteriorated density, that is, no color heterogeneity can be obtained.

In this embodiment, the intermediate transfer belt was exemplified as the intermediate transfer member for description. However, the present invention is not limited to this, but drum shape may be used.

In the above-described first to seventh embodiments, the non-image formation time is directed to a duration since an image formation start signal is inputted until the image formation on the photosensitive drum starts, that is, a so-called fore-rotation time or a so-called post-rotation time after the image formation. However, in order to more severely control, there is a case in which the effect can be more enhanced by conducting control at the so-called sheet-to-sheet time in the continuous image formation.

The above-described first to seventh embodiments may be appropriately combined with each other if the action and effect of the present invention are obtained.

(Eighth Embodiment)

Figure 9:
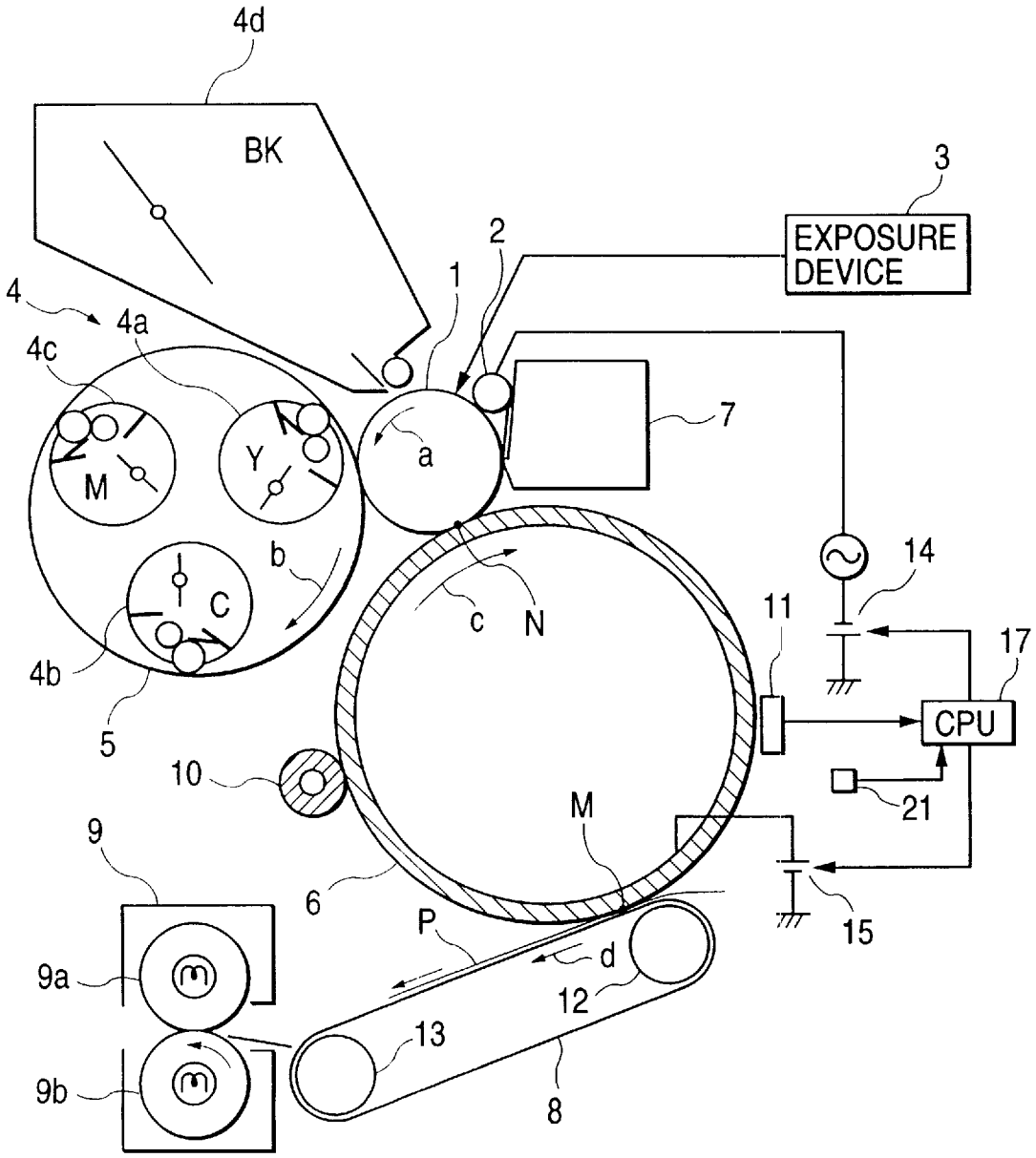
FIG. 9 is a schematically structural view showing another image forming apparatus in accordance with the present invention.

In an eighth embodiment, as shown in FIG. 9, a register detecting device 21 which detects the deviation amount (color drift) of the respective positions of multiple-color deviation amount detection toner images which have been transferred onto the intermediate transfer drum 6 is disposed on the outer side of the intermediate transfer drum 6.

The control device 17 controls the charged potential and the primary transfer potential of the photosensitive drum 1 on the basis of electric current value information which is inputted from an electric current value detecting device 16 and color drift information which is inputted from the register detecting device 21.

Then, the control of the photosensitive drum charged potential and the primary transfer potential in the image forming apparatus according to this embodiment will be described in detail.

(1) In a control mode (non-image formation) where no image is formed, the secondary transfer belt 8 is made apart from the intermediate transfer drum 6, and a solid image (a toner image for detecting a deviation amount) of the yellow of the first color is formed on the photosensitive drum 1 over the entire thrust width and primarily transferred onto the intermediate transfer drum 6.

(2) Assuming the primary transfer process of the magenta toner image of the second color, the surface of the photosensitive drum 1 is uniformly charged to the dark potential (photosensitive drum charged potential) Vd (V) by the charging roller 2 in advance, and the direct current bias which is constant-voltage-controlled to a given voltage value Vt (V) by the primary transfer bias source 15 is applied to the intermediate transfer drum 6, and the primary transfer electric current (direct current) value Itm (μA) produced at this time is detected by the electric current value detecting device 16. When the primary transfer electric current value Itm is detected by the electric current value detecting device 16, the upper surface of the intermediate transfer drum 6 is in contact with the photosensitive drum 1 through the yellow toner. In this situation, the image of magenta is not in fact produced and only the direct current bias is applied thereto.

(3) Similarly, assuming the primary transfer process of the cyan toner image of the third color and the black toner image of the fourth color, the surface of the photosensitive drum 1 is uniformly charged to the dark potential Vd (V) by the charging roller 2 in advance, and the direct current bias which is constant-voltage-controlled to a given voltage value (primary transfer potential) Vt (V) by the primary transfer bias source 15 is applied to the intermediate transfer drum 6, and the primary transfer electric current values Itc and Itk (μA) produced at this time are detected by the electric current value detecting device 16. Similarly, in this situation, the image of cyan and black is not in fact produced and only the direct current bias is applied thereto.

The above processes (1) to (3) constitute a series of electric current measurement. It should be noted that in the processes (1) to (3), the above Vd is set to, for example, −600 V, and the above Vt is set to, for example, 300 V.

(4) The above Vd is changed, and the above processes (1) to (3) are repeated.

For example, the primary transfer electric current (direct current) values Itm, Itc and Itk when Vd is changed to −550 V, −500 V, −450 V 400 V and −350 V, respectively, are sequentially measured.

(5) A Vd is selected when all of Itm, Itc and Itk of the above respective Vd are equal to or less than Ith.

For example, assuming that Ith is 1 μA, and Vt is 300 V when the measuring result is Vd=−600 V, Itm=20 μA, Itc=21 μA and Itk=22 μA;

when the measuring result is Vd=−550 V,

Itm=12 μA, Itc=13 μA and Itk=14 μA;

when the measuring result is Vd=−500 V,

Itm=5 μA, Itc=6 μA and Itk=7 μA;
when the measuring result is Vd=−450 V,

Itm=1 μA, Itc=1 μA and Itk=2 μA;
when the measuring result is Vd=−400 V,

Itm=0 μA, Itc=0 μA and Itk=1 μA; and
when the measuring result is Vd=−350 V,

Itm=0 μA, Itc=0 μA and Itk=0 μA.

In this case, Vd when all of Itm, Itc and Itk are equal to or less than Ith=1 μA become −400 V and −350 V.

(6) At a Vd when all of Itm, Itc and Itk of the respective Vd are equal to or less than Ith, the register patch (deviation amount detection toner image) is imaged on the intermediate transfer drum 6.

For example, assuming that a one-pixel line extending a main scanning direction is a register patch, an image is formed at the same sub-scanning position for the respective colors while changing the position of the main-scanning line. For example, the line is imaged in the following manner.

the line of yellow: [0, 0]–[5, 0];

the line of magenta: [5, 0]–[10, 0];

the line of cyan: [10, 0]–[15, 0]; and the line of black: [15, 0]–[20, 0]

For example, the above [0, 0]–[5, 0] represents coordinates of the start position and the end position of the line, in which 0 of [0, 0] represents the coordinates of the main scanning at the start position of the line, 0 represents the coordinates of the sub-scanning at the start position of the line, 5 of [5, 0] represents the coordinates of the main scanning at the end position of the line, and 0 represents the coordinates of the sub-scanning at the end position of the line. A unit is the number of dots or the unit representative of the length such as mm.

(7) The register patches of the respective colors on the lines for each Vd which are imaged on the intermediate transfer drum 4 are detected by the register detecting device 21.

The register detecting device 21 inputs the register patch as an image due to a sensor such as a CCD so as to detect the deviation amount (color drift) of the registration (hereinafter referred to as "register") through an image processing.

(8) The Vd having the smallest deviation amount of the register which has been detected by the register detecting device 21 but the largest absolute value is selected. For example, it is assumed that the detecting result of the color drift is as follows with the line of yellow as a reference.

When Vd=−400 V, magenta=+50 μm, cyan=+60 μm, and black=+80 μm; and when Vd=−350 V, magenta=+70 μm, cyan=+85 μm, and black=+105 μm.

In this example, "+" represents the drift of color in the downstream of the rotating direction of the intermediate transfer drum 4 with the line of yellow as a reference whereas "−" represents the drift of color in the upstream of the rotating direction of the intermediate transfer drum 4 with the line of yellow as a reference (however, in this embodiment an example of "−" is not used).

Then, in the above case, the maximum values of the respective color drifts is as follows:

When Vd=−400 V, 80 μm; and when Vd=−350 V, 105 μm.

It is judged from the above that the color drift is smaller when Vd=−400 V. As a result, Vd=−400 is selected.

(9) The density control is conducted at the dark potential (photosensitive drum charged potential) of the photosensitive drum 1 which is determined by the above process (8).

The density control is conducted by the control device 17 in such a manner that the density of the toner image (patch pattern) for the density detection (not shown) which is formed on the intermediate transfer drum 6 is detected by the density detecting sensor 11, and the developing bias Vdc which allows the most appropriate density is determined on the basis of the density information thus detected.

In this embodiment, since the control of the photosensitive drum charged potential and the primary transfer potential are conducted in the above processes (1) to (9), the primary transfer electric current can be suppressed to a given value or less in the counter-transfer, and the color drift of the respective toner images of magenta, cyan and black which are primarily transferred onto the intermediate transfer drum 6 can be suppressed to the minimum.

As stated above, and as shown in FIG. 3, the amount of counter-transfer toner increases more as the primary transfer electric current that flows in the intermediate transfer drum 6 from the primary transfer bias source 15 increases. Also as mentioned above, in FIG. 3, "better" of counter-transfer in the axis of ordinate represents that the amount of counter-transfer is small whereas "worse" thereof represents that the amount of counter-transfer is large.

In addition, according to the present inventors' study, it is proved that the above-mentioned color drift is deteriorated if the primary transfer bias is lowered.

From the above viewpoint, in this embodiment, since the primary transfer electric current value Ith which flows between the photosensitive drum 1 and the intermediate transfer drum 6 is set to 1 μA, the amount of counter-transfer can be reduced with the result that an excellent output image having no deteriorated density can be obtained. It should be noted that in this embodiment, the primary transfer electric current value Ith is set to 1 μA, but it is preferable that the primary transfer electric current value Ith is set to 0 μA, which can more reduce counter-transfer.

Also, the reason that the dark potential Vd of the photosensitive drum 1 in which the primary transfer electric current Ith is a given value or less and the absolute value is the largest is selected is because the contrast potential (Vdc−VL) and fog potential (Vdc−Vd) are going to increase. This makes it possible to ensure the toner reproduction of the output image, and it difficult to generate the fog.

(Ninth Embodiment)

A ninth embodiment will be described with reference to the image forming apparatus shown in FIG. 9. Since the image forming operation is identical with that in the first embodiment, only the control of the photosensitive drum charged potential and the primary transfer potential in this embodiment will be described in detail. In this embodiment, in order to suppress the primary transfer electric current, the primary transfer potential is made variable so as to be set to a given value.

Hereinafter, the control of the photosensitive drum charged potential and the primary transfer potential in the image forming apparatus in accordance with this embodiment will be described.

(1) In a control mode (non-image formation) where no image is formed, the secondary transfer belt 8 is made apart from the intermediate transfer drum 6, and a solid image (deviation amount detection toner image) of the yellow of the first color is formed on the photosensitive drum 1 over the entire thrust width and primarily transferred onto the intermediate transfer drum 6.

(2) Assuming the primary transfer process of the magenta toner image of the second color, the surface of the photosensitive drum 1 is uniformly charged to the dark potential (photosensitive drum charged potential) Vd (V) by the charging roller 2 in advance, and the direct current bias which is constant-voltage-controlled to a given voltage value (primary transfer potential) Vt (V) by the primary transfer bias source 15 is applied to the intermediate transfer drum 6, and the primary transfer electric current (direct current) value Itm ($\mu$A) produced at this time is detected by the electric current value detecting device 16. When the primary transfer electric current value Itm is detected by the current value detecting device 16, the upper surface of the intermediate transfer drum 6 is in contact with the photosensitive drum 1 through the yellow toner. In this situation, the image of magenta is not in fact produced and only the direct current bias is applied thereto.

(3) Similarly, assuming the primary transfer process of the cyan toner image of the third color and the black toner image of the fourth color, the surface of the photosensitive drum 1 is uniformly charged to the dark potential Vd (V) by the charging roller 2 in advance, and the direct current bias which is constant-voltage-controlled to a given voltage value (primary transfer potential) Vt (V) by the primary transfer bias source 15 is applied to the intermediate transfer drum 6, and the primary transfer electric current values Itc and Itk ($\mu$A) produced at this time are detected by the electric current value detecting device 16. Similarly, in this situation, the image of cyan and black is not in fact produced and only the direct current bias is applied thereto.

The above processes (1) to (3) constitute a series of electric current measurement. It should be noted that in the processes (1) to (3), the above Vd is set to, for example, −600 V, and the above Vt is set to, for example, 300 V.

(4) The above Vt is changed, and the above processes (1) to (3) are repeated.

For example, the primary transfer electric current (direct current) values Itm, Itc and Itk ($\mu$A) when Vt is changed to 250 V, 200 V, 150 V, 100 V and 50 V, respectively, are sequentially measured.

(5) A Vt is selected when all of Itm, Itc and Itk of the above respective Vt are equal to or less than the above Ith.

For example, assuming that Ith is 1 $\mu$A, and
when the measuring result is Vt=300 V, Itm=20 $\mu$A, Itc=21 $\mu$A and Itk=22 $\mu$A;
when the measuring result is Vt=250 V, Itm=12 $\mu$A, Itc=13 $\mu$A and Itk=14 $\mu$A;
when the measuring result is Vt=200 V, Itm=5 $\mu$A, Itc=6 $\mu$A and Itk=7 $\mu$A;
when the measuring result is Vt=150 V, Itm=1 $\mu$A, Itc=1 $\mu$A and Itk=2 $\mu$A;
when the measuring result is Vt=100 V, Itm=0 $\mu$A, Itc=0 $\mu$A and Itk=1 $\mu$A; and
when the measuring result is Vt=50 V, Itm=0 $\mu$A, Itc=0 $\mu$A and Itk=0 $\mu$A.

In this case, Vd when all of Itm, Itc and Itk are equal to or less than Ith=1 $\mu$A becomes 100 V and 50 V.

(6) At a Vt when all of Itm, Itc and Itk of the respective Vt are equal to or less than Ith, the register patch (deviation amount detection toner image) is imaged on the intermediate transfer drum 6 in the same manner as the first embodiment.

(7) The register patches of the respective colors on the lines for each Vt which are imaged on the intermediate transfer drum 6 are detected by the register detecting device 21.

(8) The Vt having the smallest deviation amount of the register which has been detected by the register detecting device 21 but the largest absolute value is selected as in the same manner of the first embodiment.

(9) The density control is conducted at the dark potential (photosensitive drum charged potential) Vd of the photosensitive drum 1 and the primary transfer potential Vt which are determined by the above process (8).

The density control is conducted by the control device 17 in such a manner that the density of the toner image (patch pattern) for the density detection (not shown) which is formed on the intermediate transfer drum 6 is detected by the density detecting sensor 11, and the developing bias Vdc which allows the most appropriate density is determined on the basis of the density information thus detected.

As described above, in this embodiment, since the control of the photosensitive drum charged potential and the primary transfer potential are conducted in the above processes (1) to (9) to set the primary transfer electric current value Ith to 1 $\mu$A, the amount of counter-transfer can be reduced, with the result that an excellent output image having no deteriorated density can be obtained. In this embodiment, although the primary transfer electric current value Ith is set to 1 $\mu$A, it is preferable that the primary transfer electric current value Ith is set to 0 $\mu$A, which can more reduce counter-transfer.

Also, the reason that the primary transfer potential Vt when the primary transfer electric current Ith is equal to or less than a given value and the absolute value is the largest is selected is to improve the color drift and to maintain the transfer property. This is because when the transfer potential is lowered, the transfer efficiency slightly drops.

It should be noted that in this embodiment, the density control of the above process (9) may not be always conducted.

(Tenth Embodiment)

A tenth embodiment will be described with reference to the image forming apparatus shown in FIG. 9. Since the image forming operation is identical with that in the first embodiment, only the control of the photosensitive drum charged potential and the primary transfer potential in this embodiment will be described in detail. In this embodiment, in order to suppress the primary transfer current, the photosensitive drum charged potential and the primary transfer potential are made variable so as to be set to a given value.

Hereinafter, the control of the photosensitive drum charged potential and the primary transfer potential in the image forming apparatus in accordance with this embodiment will be described.

In this embodiment, although the same operation of the above processes (1) to (9) in the first or second embodiment is conducted, the photosensitive drum charged potential Vd and the primary transfer potential Vt of the intermediate transfer drum 6 are made variable, respectively. That is,
when Vd=−600 V,
Vt=300 V, 250 V, 200 V, 150 V, 100 V and 50 V;
when Vd=−550 V,
Vt=300 V, 250 V, 200 V, 150 V, 100 V and 50 V;
when Vd=−500 V,
Vt=300 V, 250 V, 200 V, 150 V, 100 V and 50 V;
when Vd=−450 V,
Vt=300 V, 250 V, 200 V, 150 V, 100 V and 50 V;
when Vd=−400 V,
Vt=300 V, 250 V, 200 V, 150 V, 100 V and 50 V; and
when Vd=−350 V,
Vt=300 V, 250 V, 200 V, 150 V, 100 V and 50 V.
That is, there are 36 Vts.

From the above combination, similarly to the first and second embodiments, setting of Vd and Vt when all of the primary transfer electric current (direct current) values Itm, Itc and Itk are equal to or less than a given value Ith is selected. Vd is selected for the variable amount of Vd and Vt so that Vt is prevented from changing as much as possible. This is to maintain the color drift and the transfer property.

As described above, according to this embodiment, since both of Vd and Vt are variable, counter-transfer and color drift are reduced more effectively, thereby being capable of obtaining an excellent output image.

By the way, in the control of the photosensitive drum charged potential and the primary transfer potential in the above-described respective embodiments, there is a case in which since the photosensitive drum charged potential (dark potential) Vd is lowered, the contrast of the developing bias Vdc and the exposed portion potential are not sufficiently taken such that the sufficient bearing amount of toner is not obtained. In this case, for example, the r.p.m. of the developing sleeve increases to enhance the developing efficiency so that the toner bearing amount is increased, or the exposure amount of the laser beam may increase so that the exposed portion potential is lowered to take the contrast.

It should be noted that because if the r.p.m. of the developing sleeve increases, the durability is deteriorated, and if the exposure amount of the laser beam increases, the life of the laser is shortened, the r.p.m. and the exposure amount may be returned to the original ones if the counter-transfer and color drift are not produced when the photosensitive drum is replaced by new one.

Also, in the above eighth and ninth embodiments, only the yellow solid image is formed to detect Itm, Itc and Itk. However, this can be made because the first color is yellow, and the present invention is not limited to this when the color order is different. In other words, the first color is imaged, and the primary transfer process of the second to fourth colors are assumed, and the primary transfer voltage is applied and an electric current that flows at this time is detected.

Also, because the number of times of counter-transfer increases more as "n" of the n-th color is larger, and the toner amount of the first color on the intermediate transfer drum 6 is reduced, in the above first, second and third embodiments, the following expression is satisfied.

$$Itm<Itc<Itk$$

For that reason, this is an easy case in which only Itk is detected and the above-mentioned control is conducted, and there is a case in which the sufficient effect on the counter-transfer is obtained.

Conversely, although being complicated, there is a case in which the toner image of the second color is formed, and an electric current in the primary transfer of the third and fourth colors is detected, and there is a case in which the toner image of the third color is formed, and an electric current in the primary transfer of the fourth color is detected. In this case, a plurality of colors may be formed at positions different in the main scanning direction on the intermediate transfer drum 6 so that electric currents for a plurality of colors are detected at changed timing by one image formation at once, and in this case, the tact time of this control is shortened.

Also, the image formed during the above control is a solid image of the total thrust width. However, if half-tone, gradation patch, secondary color, tertiary color and so on are fixed for each control, the present invention is not limited to this.

When the values of the above Vd and Vt change, a plurality of Vd and Vt may be set at changed timing in one image formation to detect the electric current, and this makes it possible to shorten the tact time of this control.

In addition, if the charged potential of the photosensitive drum 1 and the primary transfer potential of the intermediate transfer drum 6 are monitored by an electrometer and fed back, control can be made with higher accuracy.

Also, there is a case in which an upper limit is given to the absolute value of a difference between Vd and Vt, and the above control is conducted within that range so that the more effect on the counter-transfer is obtained.

Also, the values of Vd, VL and Vt are not limited to this embodiment, and the same effect is obtained if they are optimized for each system.

(Eleventh Embodiment)

Figure 10:
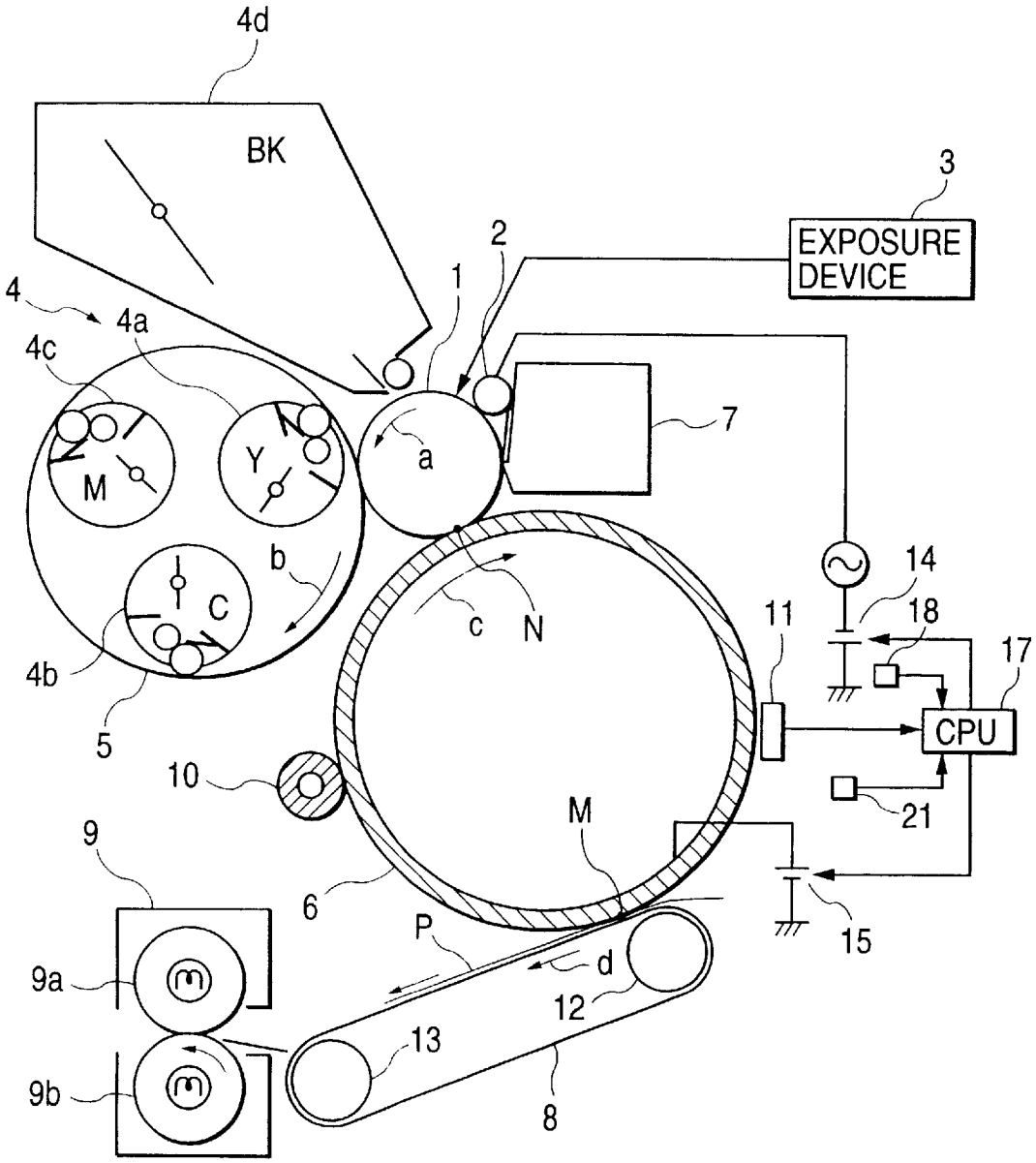
FIG. 10 is a schematically structural view showing another image forming apparatus in accordance with the present invention.

FIG. 10 is a schematically structural view showing an image forming apparatus in accordance with an eleventh embodiment. It should be noted that the same parts as those in the image forming apparatus shown in FIG. 1 are designated by identical references, and duplex description will be omitted.

From the viewpoint that counter-transfer is liable to occur under the high-temperature and high-humidity environments, in this embodiment, as shown in FIG. 10, a temperature and humidity detecting sensor 18 is disposed within an image forming apparatus, and the detected temperature and humidity information is inputted to the control device 17. The control device 17 is so designed as to turns on/off the control of the photosensitive drum charged potential and the primary transfer voltage in any one of the above first, second and third embodiments, in the case where the temperature and humidity are high (for example, the temperature of 30° C. and the humidity of 80%), on the basis of the inputted temperature and humidity information.

As described above, similarly in this embodiment, the amount of counter-transfer and color drift can be reduced even in the case where the image forming apparatus is put under the environments in which the temperature and humidity are high so that an excellent output image can be obtained.

(Twelfth Embodiment)

Figure 11:
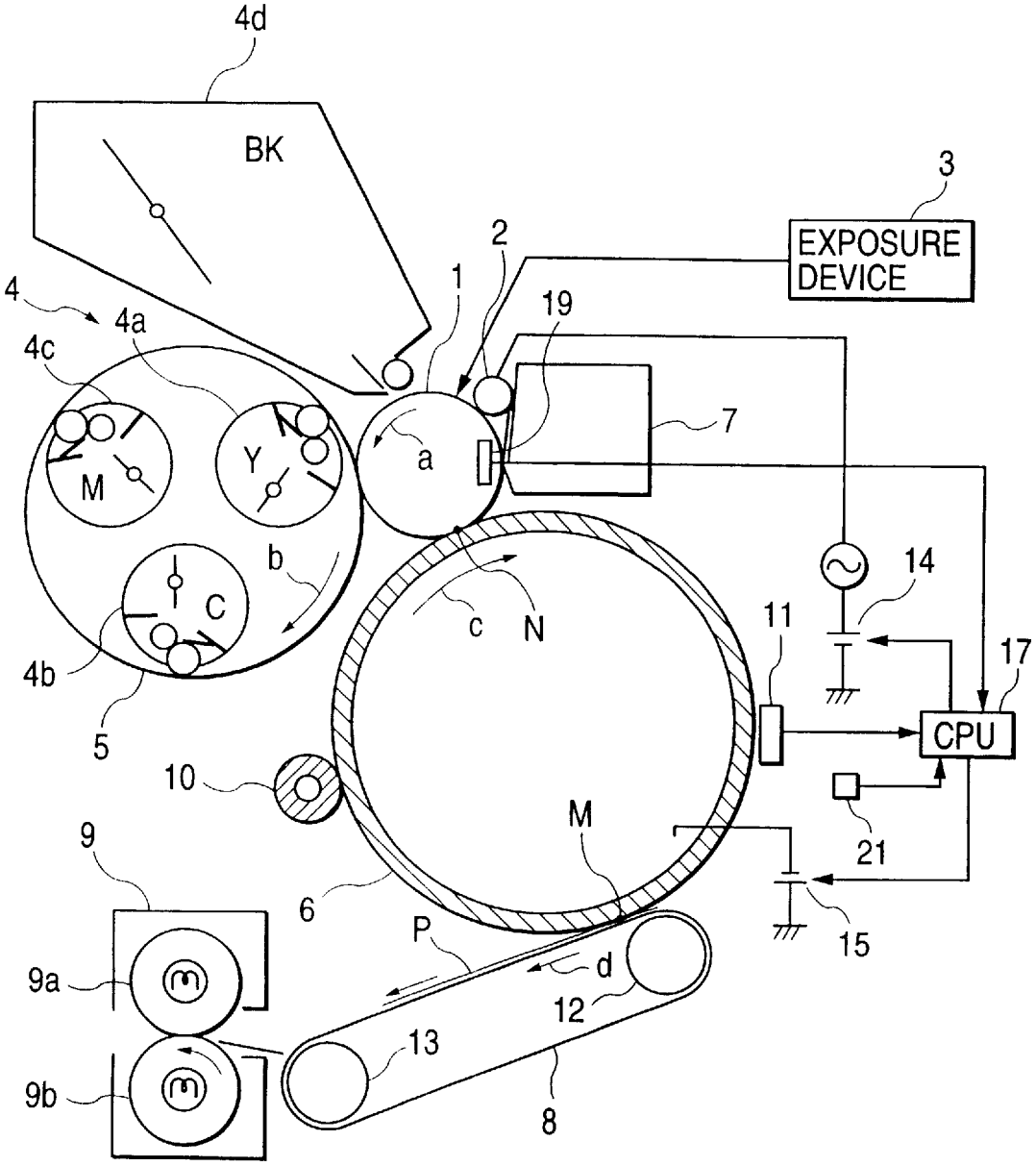
FIG. 11 is a schematically structural view showing another image forming apparatus in accordance with the present invention.

FIG. 11 is a schematically structural view showing an image forming apparatus in accordance with a twelfth embodiment of the present invention. It should be noted that the same parts as those in the image forming apparatus shown in FIG. 1 are designated by identical references, and duplex description will be omitted.

From the view point that counter-transfer is liable to occur as the durabilitive life of the photosensitive drum is progressed, in this embodiment, there is provided a photosensitive drum life detecting sensor 19 as shown in FIG. 11, and the detected photosensitive drum life information is inputted to the control device 17. The control device 17 is so designed as to turn on/off the control of the photosensitive drum charged potential and the primary transfer potential in any one of the above-described embodiments in response to the progress of the life of the photosensitive drum 1 due to the inputted photosensitive drum life information.

As described above, in this embodiment, the amount of counter-transfer and color drift can be reduced even if the life of the photosensitive drum 1 is progressed, so that an excellent output image can be obtained.

The temperature and humidity control and the control due to the life of the photosensitive drum 1 in the embodiments described above are made because an electric current in the primary transfer increases by lowering the electric resistance of the photosensitive drum 1, the intermediate transfer drum 6 or the like under the high temperature and high humidity environment, by lowering the electric resistance with the photoconductive layer of the photosensitive drum 1 being worn due to the durability of the photosensitive drum 1, and so on, and the present invention is not limited to this depending on the construction of the image forming apparatus.

(Thirteenth Embodiment)

Figure 12:
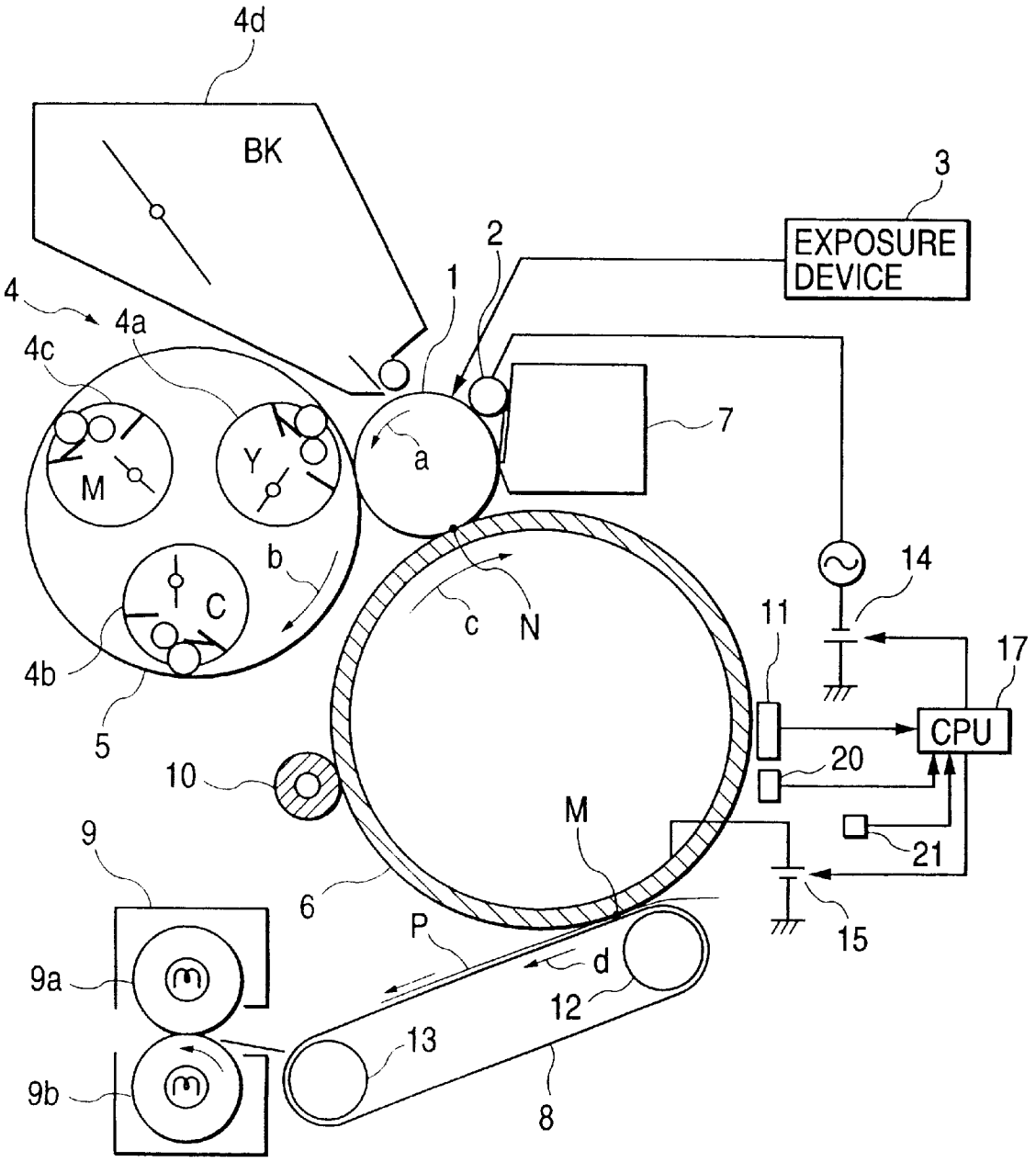
FIG. 12 is a schematically structural view showing another image forming apparatus in accordance with the present invention.

FIG. 12 is a schematically structural view showing an image forming apparatus in accordance with a thirteenth embodiment. It should be noted that the same parts as those in the image forming apparatus shown in FIG. 1 are designated by identical references, and duplex description will be omitted.

In this embodiment, as shown in FIG. 12, a toner image reflection density sensor 20 is so disposed as to oppose the surface of the intermediate transfer drum 6, and the detected reflection density information of the toner image for the density detection is inputted to the control device 17. The control device 17 is so designed as to judge whether counter-transfer occurs or not, on the basis of the inputted reflection density information of the toner image, and if judging that counter-transfer occurs, turns on/off the control of the photosensitive drum charged potential and the primary transfer potential in any one of the above first to twelfth embodiments.

As described above, similarly in this embodiment, the amount of counter-transfer can be reduced so that an output image having no deteriorated density can be obtained.

In addition, in the control of the photosensitive drum charged potential Vd and the primary transfer potential Vt in the above-described respective embodiments, the above register patch (deviation amount detection toner image) may be secondarily transferred and fixed onto the transfer material P and outputted, and an operator judges through his eyes and inputs Vd, Vt and so on from an operating section (not shown), or the like of the image forming apparatus. Further, Vd and Vt may be inputted to the control device 17 from an image read section (not shown) or the like so that judgement is made by the control device 17.

Also, the above register patch is not limited to a one-pixel line that extends in the main-scanning direction as in the above-described respective embodiments, but a plural-pixel line may be used. In addition, a pattern in which the line is repeated in the sub-scanning direction may be applied if the color drift can be judged. Also, in the case of an image forming apparatus in which the color drift in the main-scanning direction is detected and corrected, a line in the main-scanning or sub-scanning direction or a lattice image may be formed of the above pattern.

Also, in the case of the image forming apparatus in which the color drift rather than counter-transfer is a remarkable problem, the potential that improves the color drift may be set. For example, a limit is given to the maximum value of the color drift amount, and in the case of the potential setting which exceeds the limit, the above Ith may be increased.

In the above-described respective embodiments, the intermediate transfer drum was exemplified as the intermediate transfer member for description. However, the present invention is not limited to the drum shape if it is an intermediate transfer member, and the same effect is obtained if the belt-shaped intermediate transfer member is used.

Also, in the above-described respective embodiments, the system in which the primary transfer bias is applied to the core of the intermediate transfer drum was exemplified. However, the present invention may be applied to a system in which a bias is applied from the back side of a transfer nip by a belt-shaped intermediate transfer member due to a roller, a blade, a corona charging unit or the like.

Also, in the above-described respective embodiments, the belt transfer system due to the secondary transfer belt is used as the secondary transfer means, but a corona transfer or roller transfer system may be used.

In addition, in the above-described respective embodiments, the negative process is exemplified.

However, it is needless to say that a positive process is applicable to the present invention.

The above-described first to thirteenth embodiments may be appropriately combined together if the action and effect of the present invention are obtained.

What is claimed is:

1. An image forming apparatus, comprising:

an image bearing member;

charging means for charging said image bearing member;

image forming means for forming multiple-color toner images on said image bearing member which is charged by said charging means;

an intermediate transfer member;

voltage applying means for applying a voltage to said intermediate transfer member to sequentially transfer the multiple-color toner images which are formed on said image bearing member by said image forming means onto said intermediate transfer member at a transfer position in a superposing manner;

wherein the multiple-color toner images which are transferred onto said intermediate transfer member by said voltage applying means are transferred onto a transfer material;

wherein the voltage which is applied to said intermediate transfer member by said voltage applying means is constant-voltage-controlled;

wherein there is a period when said image bearing member, which is charged by said charging means and on which no toner image is formed by said image forming means, and the toner image which is transferred onto said intermediate transfer member exist at the transfer position;

current detecting means for detecting an electric current that flows in said voltage applying means when the voltage is applied to said intermediate transfer member by said voltage applying means during the period; and control means for controlling at least one of a voltage which is applied to said charging means and the voltage which is applied to said intermediate transfer member by said voltage applying means based on a detection result by said current detecting means.

2. An image forming apparatus according to claim 1, wherein the period comprises a plurality of periods so that at least one of the voltage which is applied to said charging means and the voltage which is applied to said intermediate transfer member by said voltage applying means is controlled by said control means.

3. An image forming apparatus according to claim 2, wherein the detecting operation of said current detecting means is conducted for each of the periods; and wherein said control means controls at least one of the voltage which is applied to said charging means and the voltage which is applied to said intermediate transfer member by said voltage applying means based on a plurality of detection results by said current detecting means.

4. An image forming apparatus according to claim 1, wherein said voltage applying means comprises a constant voltage source.

5. An image forming apparatus according to claim 1, wherein said voltage applying means comprises an electrode which is in contact with one side opposite to the other side of said intermediate transfer member onto which the toner image is transferred, and a constant voltage source for applying a voltage to said electrode.

6. An image forming apparatus according to claim 1, wherein said control means controls an absolute value of an electric current that flows into said voltage applying means to be set to a predetermined value or less when the toner image on said image bearing member is transferred onto said intermediate transfer member by said voltage applying means.

7. An image forming apparatus according to claim 6, wherein the predetermined value is 1 $\mu$A.

8. An image forming apparatus according to claim 1, wherein said control means controls a difference between the voltage which is applied to said charging means and the voltage which is applied to said intermediate transfer member by said voltage applying means to be set within a predetermined range.

9. An image forming apparatus according to claim 1, further comprising electric potential detecting means for detecting a charged potential of said image bearing member;

wherein said control means controls the voltage which is applied to said charging means based on detection results of said electric potential detecting means and said current detecting means.

10. An image forming apparatus according to claim 1, further comprising position detecting means for detecting a position of the toner images of the respective colors which are transferred onto said intermediate transfer member from said image bearing member;

wherein said control means controls at least one of the voltage which is applied to said charging means and the voltage which is applied to said intermediate transfer member by said voltage applying means based on a detection result of said position detecting means.

11. An image forming apparatus according to claim 1, wherein said charging means charges said image bearing member by use of a voltage value set by said control means; and wherein said image forming means forms the toner image on said image bearing member.

12. An image forming apparatus according to claim 11, wherein said voltage applying means transfers the toner image on said image bearing member onto said intermediate transfer member by use of the voltage value set by said control means.

13. An image forming apparatus according to claim 12, further comprising density detecting means for detecting a density of the toner image which is transferred onto said intermediate transfer member;

wherein said control means controls the density of the toner image formed on said image bearing member by said image forming means based on a detection result of said density detecting means.

14. An image forming apparatus according to claim 1, further comprising temperature and humidity detecting means for detecting temperature and humidity within said apparatus;

wherein said control means judges whether control operation is conducted or not, based on a detection result of said temperature and humidity detecting means.

15. An image forming apparatus according to claim 1, further comprising life detecting means for detecting an operating life of said image bearing member;

wherein said control means judges whether control operation is conducted or not, based on a detection result of said life detecting means.

16. An image forming apparatus according to claim 15, wherein said life detecting means detects a thickness of a photoconductive layer of said image bearing member.

17. An image forming apparatus according to claim 1, further comprising density detecting means for detecting a density of the toner image transferred onto said intermediate transfer member, wherein said control means judges whether or not to performs a control operation based on a detection result of said density detecting means.

18. An image forming apparatus, comprising:

a plurality of image bearing members;

a plurality of charging means for charging said plurality of image bearing members, respectively;

a plurality of image forming means for forming multiple-color toner images, respectively, on said plurality of image bearing members which are charged by said plurality of charging means;

an intermediate transfer member;

a plurality of voltage applying means for applying a voltage to said intermediate transfer member to sequentially transfer the multiple-color toner images which are formed on said plurality of image bearing members by said plurality of image forming means onto said intermediate transfer member at a plurality of transfer positions in a superposing manner;

wherein the multiple-color toner images which are transferred onto said intermediate transfer member by said plurality of voltage applying means are transferred onto a transfer material;

wherein the voltage which is applied to said intermediate transfer member by said plurality of voltage applying means is constant-voltage-controlled;

wherein there is a period when one of said image bearing members, which is charged by a corresponding one of said charging means and on which no toner image is formed by a corresponding one of said image forming means, and the toner image which is transferred onto said intermediate transfer member exist at a corresponding one of the transfer positions;

current detecting means for detecting an electric current that flows in a corresponding one of said voltage applying means when the voltage is applied to said intermediate transfer member by said corresponding voltage applying means during the period; and control means for controlling at least one of a voltage which is applied to said corresponding charging means and a voltage which is applied to said intermediate transfer member by said corresponding voltage applying means based on a detection result by said current detecting means.

19. An image forming apparatus according to claim 18, wherein the period exists at each of the plurality of transfer positions; and wherein said current detecting means detects electric current values that flow in said plurality of voltage applying means when the voltage is applied to said intermediate transfer member from said plurality of voltage applying means, respectively.

20. An image forming apparatus according to claim 19, wherein said control means controls at least one of a voltage which is applied to said plurality of charging means and the voltage which is applied to said intermediate transfer member by said plurality of voltage applying means based on a plurality of detection results by said current detecting means.

21. An image forming apparatus according to claim 18, wherein said voltage applying means comprises a constant voltage source.

22. An image forming apparatus according to claim 18, wherein at least one of said plurality of voltage applying means comprises an electrode which is in contact with one side opposite to the other side of said intermediate transfer member onto which the toner image is transferred; and a constant voltage source for applying a voltage to said electrode.

23. An image forming apparatus according to claim 18, wherein said control means controls an absolute value of an electric current that flows into said corresponding voltage applying means to be set to a predetermined value or less when the toner image on said one image bearing member is transferred onto said intermediate transfer member by said corresponding voltage applying means.

24. An image forming apparatus according to claim 23, wherein the predetermined value is 1 $\mu$A.

25. An image forming apparatus according to claim 18, wherein said control means controls a difference between the voltage which is applied to said corresponding charging means and the voltage which is applied to said intermediate transfer member by said corresponding voltage applying means to be set within a predetermined range.

26. An image forming apparatus according to claim 18, further comprising a plurality of electric potential detecting means for detecting charged potentials of said plurality of image bearing members, respectively;

wherein said control means controls the voltage which is applied to said corresponding charging means based on detection results of a corresponding one of said electric potential detecting means and said current detecting means.

27. An image forming apparatus according to claim 18, further comprising position detecting means for detecting positions of the toner images of the respective colors which are transferred onto said intermediate transfer member from said plurality of image bearing members; and wherein said control means controls at least one of the voltage which is applied to said corresponding charging means and the voltage which is applied to said intermediate transfer member by said corresponding voltage applying means based on a detection result of a corresponding one of said position detecting means.

28. An image forming apparatus according to claim 18, wherein said corresponding charging means charges said corresponding image bearing member by use of a voltage value set by said control means; and wherein said corresponding image forming means forms the toner image on said one image bearing member.

29. An image forming apparatus according to claim 28, wherein said corresponding voltage applying means transfers the toner image on said one image bearing member onto said intermediate transfer member by use of the voltage value set by said control means.

30. An image forming apparatus according to claim 29, further comprising density detecting means for detecting a density of a toner image which is transferred onto said intermediate transfer member;

wherein said control means controls the density of the toner image formed on said image bearing member by said corresponding image forming means based on a detection result of said density detecting means.

31. An image forming apparatus according to claim 18, further comprising temperature and humidity detecting means for detecting temperature and humidity within said apparatus;

wherein said control means judges whether a control operation is conducted or not, based on a detection result of said temperature and humidity detecting means.

32. An image forming apparatus according to claim 18, further comprising life detecting means for detecting an operating life of each one of said plurality of image bearing members;

wherein said control means judges whether control operation is conducted or not, based on a detection result of said life detecting means.

33. An image forming apparatus according to claim 32, wherein said life detecting means detects a thickness of a photoconductive layer of said image bearing member.

34. An image forming apparatus according to claim 18, further comprising density detecting means for detecting a density of the toner image transferred onto said intermediate transfer member, wherein said control means judges whether or not to perform a control operation based on a detection result of said density detecting means.

35. An image forming apparatus, comprising:

an image bearing member;

charging means for charging said image bearing member;

image forming means for forming a toner image on said image bearing member which is charged by said charging means;

an intermediate transfer member;

voltage applying means for applying a voltage to said intermediate transfer member to transfer the toner image which is formed on said image bearing member by said image forming means onto said intermediate transfer member;

wherein the toner image which is transferred onto said intermediate transfer member by said voltage applying means is transferred onto a transfer material;

wherein a voltage which is applied to said intermediate transfer member by said voltage applying means is constant-voltage-controlled;

current detecting means for detecting an electric current that flows in said voltage applying means when the voltage is applied to said intermediate transfer member by said voltage applying means; and control means for controlling a voltage which is applied to said intermediate transfer member by said voltage applying means based on a detection result by said detecting means.

36. An image forming apparatus according to claim 35, wherein said image bearing member is charged by said charging means and no toner image is formed by said image forming means during a period when the detecting operation is conducted by said detecting means.

37. An image forming apparatus according to claim 36, wherein the toner image which is transferred onto said intermediate transfer member exists at a transfer position where the toner image is transferred onto said intermediate transfer member from said image bearing member during the period.

38. An image forming apparatus according to claim 35, wherein said voltage applying means comprises a constant voltage source.

39. An image forming apparatus according to claim 35, wherein said voltage applying means comprises an electrode which is in contact with one side opposite to the other side of said intermediate transfer member onto which the toner image is transferred, and a constant voltage source for applying a voltage to said electrode.

40. An image forming apparatus according to claim 35, wherein said control means controls an absolute value of an electric current that flows into said voltage applying means to be set to a predetermined value or less when the toner image on said image bearing member is transferred onto said intermediate transfer member by said voltage applying means.

41. An image forming apparatus according to claim 40, wherein the predetermined value is 1 $\mu$A.

42. An image forming apparatus according to claim 35, wherein said control means controls a difference between the voltage which is applied to said charging means and the voltage which is applied to said intermediate transfer member by said voltage applying means to be set within a predetermined range.

43. An image forming apparatus according to claim 35, further comprising electric potential detecting means for detecting a charged potential of said image bearing member;

wherein said control means controls the voltage which is applied to said charging member based on detection results of said electric potential detecting means and said current detecting means.

44. An image forming apparatus according to claim 35, wherein said charging means charges said image bearing member by use of a voltage value set by said control means, and wherein said image forming means forms the toner image on said image bearing member.

45. An image forming apparatus according to claim 44, wherein said voltage applying means transfers the toner image on said image bearing member onto said intermediate transfer member by use of the voltage value set by said control means.

46. An image forming apparatus according to claim 45, further comprising density detecting means for detecting a density of the toner image which is transferred onto said intermediate transfer member;

wherein said control means controls the density of the toner image formed on said image bearing member by said image forming means based on a detection result of said density detecting means.

47. An image forming apparatus according to claim 35, further comprising temperature and humidity detecting means for detecting temperature and humidity within said apparatus;

wherein said control means judges whether control operation is conducted or not, based on a detection result of said temperature and humidity detecting means.

48. An image forming apparatus according to claim 35, further comprising life detecting means for detecting an operating life of said image bearing member;

wherein said control means judges whether control operation is conducted or not, based on a detection result of said life detecting means.

49. An image forming apparatus according to claim 48, wherein said life detecting means detects a thickness of a photoconductive layer of said image bearing member.

50. An image forming apparatus according to claim 35, further comprising density detecting means for detecting a density of the toner image transferred onto said intermediate transfer member, wherein said control means judges whether or not to perform a control operation based on a detection result of said density detecting means.

51. An image forming apparatus, comprising:

an image bearing member;

charging means for charging said image bearing member;

image forming means for forming a toner image on said image bearing member which is charged by said charging means;

an intermediate transfer member;

voltage applying means for applying a voltage to said intermediate transfer member to transfer the toner image which is formed on said image bearing member by said image forming means at a transfer position onto said intermediate transfer member;

wherein the toner image which is transferred onto said intermediate transfer member by said voltage applying means is transferred onto a transfer material;

wherein a voltage which is applied to said intermediate transfer member by said voltage applying means is constant-voltage-controlled;

current detecting means for detecting an electric current that flows in said voltage applying means when the voltage is applied to said intermediate transfer member by said voltage applying means in a period of time during which the toner image transferred onto said intermediate transfer member is passing the transfer position; and control means for controlling at least one of a voltage which is applied to said charging means and a voltage which is applied to said intermediate transfer member by said voltage applying means based on a detection result of said current detecting means.

52. An image forming apparatus according to claim 51, wherein said image bearing member passing said transfer position in the period of time is charged by said charging means and is not formed with toner image thereon by said image forming means.

53. An image forming apparatus according to claim 51 or 52, wherein said voltage applying means comprises a constant voltage source.

54. An image forming apparatus according to claim 51 or 52, wherein said voltage applying means comprises an electrode which is in contact with one side opposite to the other side of said intermediate transfer member onto which the toner image is transferred, and a constant voltage source for applying a voltage to said electrode.

55. An image forming apparatus according to claim 51 or 52, wherein said control means controls an absolute value of an electric current that flows into said voltage applying means to be set to a predetermined value or less when the toner image on said image bearing member is transferred onto said intermediate transfer member by said voltage applying means.

56. An image forming apparatus according to claim 55, wherein the predetermined value is 1 $\mu$A.

57. An image forming apparatus according to claim 51 or 52, wherein said control means controls a difference between the voltage which is applied to said charging means and the voltage which is applied to said intermediate transfer member by said voltage applying means to be set within a predetermined range.

58. An image forming apparatus according to claim 51 or 52, further comprising electric potential detecting means for detecting a charged potential of said image bearing member;

wherein said control means controls the voltage which is applied to said image bearing member by said charging member based on detection results of said electric potential detecting means and said current detecting means.

59. An image forming apparatus according to claim 51 or 52, wherein said charging means charges said image bearing member by use of a voltage value set by said control means; and wherein said image forming means forms the toner image on said image bearing member.

60. An image forming apparatus according to claim 59, wherein said voltage applying means transfers the toner image on said image bearing member onto said intermediate transfer member by use of the voltage value set by said control means.

61. An image forming apparatus according to claim 60, further comprising density detecting means for detecting a density of the toner image which is transferred onto said intermediate transfer member;

wherein said control means controls the density of the toner image formed on said image bearing member by said image forming means based on a detection result of said density detecting means.

62. An image forming apparatus according to claim 51 or 52, further comprising temperature and humidity detecting means for detecting temperature and humidity within said apparatus;

wherein said control means judges whether a control operation is conducted or not, based on a detection result of said temperature and humidity detecting means.

63. An image forming apparatus according to claim 51 or 52, further comprising life detecting means for detecting an operating life of said image bearing member;

wherein said control means judges whether a control operation is conducted or not, based on a detection result of said life detecting means.

64. An image forming apparatus according to claim 63, wherein said life detecting means detects a thickness of a photoconductive layer of said image bearing member.

65. An image forming apparatus according to claim 51 or 52, further comprising density detecting means for detecting a density of the toner image transferred onto said intermediate transfer member, wherein said control means judges whether or not to perform a control operation based on a detection result of said density detecting means.

* * * * *

UNITED STATES PATENT AND TRADEMARK OFFICE

CERTIFICATE OF CORRECTION

PATENT NO. : 6,253,038 B1
DATED : June 26, 2001
INVENTOR(S) : Yoshikuni Ito et al.

It is certified that error appears in the above-identified patent and that said Letters Patent is hereby corrected as shown below:

Column 3,
Line 18, "Ω. - cm." should read -- Ω. cm. --.

Column 8,
Line 24, "more" should read -- further --.

Column 9,
Line 64, "more" should read -- further --.

Column 15,
Line 19, "manner." should read -- manner: --; and
Line 23, "0]" should read -- 0]. --.

Column 16,
Line 36, "more" should read -- further --; and
Line 43, "it" should read -- it is --.

Column 18,
Line 21, "more" should read -- further --.

Column 20,
Line 22, "turns" should read -- turn --.

Column 24,
Line 9, "performs" should read -- perform --.

Signed and Sealed this

Fourth Day of November, 2003

JAMES E. ROGAN
*Director of the United States Patent and Trademark Office*